US008590564B2

(12) United States Patent
Burkhart, Sr. et al.

(10) Patent No.: US 8,590,564 B2
(45) Date of Patent: Nov. 26, 2013

(54) INTEGRATED BULK FLUIDS MANAGEMENT SYSTEM

(71) Applicants: Kurt A. Burkhart, Sr., North Granby, CT (US); Ronald E. Burkhart, Sr., Southwick, MA (US)

(72) Inventors: Kurt A. Burkhart, Sr., North Granby, CT (US); Ronald E. Burkhart, Sr., Southwick, MA (US)

(73) Assignee: Retain-It, LLC, Granby, CT (US)

( * ) Notice: Subject to any disclaimer, the term of this patent is extended or adjusted under 35 U.S.C. 154(b) by 0 days.

(21) Appl. No.: 13/732,963

(22) Filed: Jan. 2, 2013

(65) Prior Publication Data

US 2013/0115003 A1 May 9, 2013

Related U.S. Application Data

(62) Division of application No. 13/093,665, filed on Apr. 25, 2011, now Pat. No. 8,360,100.

(60) Provisional application No. 61/327,418, filed on Apr. 23, 2010.

(51) Int. Cl.

| | |
|---|---|
| ***E03B 11/14*** | (2006.01) |
| ***B65D 6/40*** | (2006.01) |
| ***B65D 21/02*** | (2006.01) |

(52) U.S. Cl.

USPC ..... 137/573; 137/574; 137/265; 137/561 A; 220/4.26; 220/23.2; 220/23.4; 405/45; 405/46; 405/47; 210/170.03; 210/170.08

(58) Field of Classification Search

USPC ..... 137/265, 573, 574, 599.01, 561 A; 220/4.26, 23.2, 23.4; 402/45, 46, 47; 210/170.03, 170.08

See application file for complete search history.

(56) References Cited

U.S. PATENT DOCUMENTS

| | | | | |
|---|---|---|---|---|
| 3,339,366 | A | 9/1967 | Gogan et al. | |
| 5,249,887 | A | 10/1993 | Phillips | |
| 5,810,510 | A | 9/1998 | Urriola | |
| 6,491,473 | B2 | 12/2002 | Veazey | |
| 6,779,946 | B1 | 8/2004 | Urriola et al. | |
| 7,056,058 | B2 | 6/2006 | Urriola et al. | |
| 7,160,058 | B2 | 1/2007 | Burkhart | |
| 7,344,335 | B2 | 3/2008 | Burkhart | |
| 7,621,695 | B2 | 11/2009 | Smith et al. | |
| D617,867 | S | 6/2010 | May | |
| 7,892,425 | B2 | 2/2011 | Generes et al. | |
| 8,360,100 | B2 * | 1/2013 | Burkhart et al. | 137/573 |
| 2006/0034662 | A1 | 2/2006 | Burkhart | |
| 2009/0226260 | A1 | 9/2009 | Boulton et al. | |
| 2009/0279953 | A1 | 11/2009 | Allard et al. | |

OTHER PUBLICATIONS

International Search Report and Written Opinion of the International Searching Authority; PCT/US2011/033744; Issued: Jun. 27, 2011; 10 pages.

* cited by examiner

*Primary Examiner* — Craig Schneider
*Assistant Examiner* — Atif Chaudry
(74) *Attorney, Agent, or Firm* — St. Onge Steward Johnston & Reens LLC

(57) ABSTRACT

Modular storage and controlled outflow systems for controlling a flow of water and methods of assembly of modular storage and controlled outflow systems having indirect flow of water through the system. Modular systems for controlling a flow of water having beams extending across the modules to direct the flow of water in an indirect manner or a serpentine or semi-serpentine manner. Modular storage and controlled outflow systems for treatment and filtration of water.

8 Claims, 21 Drawing Sheets

INTEGRATED BULK FLUIDS MANAGEMENT SYSTEM

FIELD OF THE INVENTION

The invention is directed to modular water retention and detention systems, the application of internal flow control systems for secondary usages and methods of assembly of such systems. The invention is also directed to modular liquid storage with controlled outflow devices and methods of assembly and application of such systems.

BACKGROUND OF THE INVENTION

Stormwater retention and detention systems (for example, also known as storage structures with controlled outflow devices) are systems typically installed underground, that are used for accommodating surface stormwater runoff by diverting and storing water to prevent pooling of water at the ground surface.

Although stormwater (or water) is being referenced generally for descriptive purposes, such liquid identification for this patent can be interchangeable with stormwater, groundwater, drinking water, irrigation water, sewerage and wastewater, or industrial process water and the associated characteristics of such specific liquid being referenced for management purposes.

Liquid retention and detention systems typically consist of a structural support component (in the form of a container or vessel), with an available storage volume and a controlled outlet flow device for metering discharge from the system. These systems are typically installed underground, but can be designed for above ground applications. The industry historically locates these systems at a lower elevation than the collection basin surface (or system) so as to take advantage of the natural potential energy (head) associated with liquid flows to eliminate the need for mechanical devices such as pumps. Stormwater systems are typically located in close vicinity of the collection area, such as under a parking lot, roadway or building to optimize the use of the land area.

Other uses of storage and controlled outflow systems involves having greywater piped into the system directly from a building, groundwater which flows into the system through the ground, and blackwater, which is pumped into the system. Greywater includes wastewater generated from domestic activities such as laundry, dishwashing, and bathing, which can be recycled on-site. Blackwater includes greywater and anything that goes down drains, including toilet water.

Water storage with controlled outflow systems are generally large structures, and thus, may be provided as modular systems that can be assembled in pieces yet meet the same intent as a singular large structure. There is a need to provide modular systems because modular systems are easier to install, allow for greater design flexibility, and have lower installation costs than nonmodular systems. This is because water storage and controlled outflow systems typically require very large storage volumes requiring heavy structural components to contain them.

It is also an advantage for the structure of a modular system to be accessible and large enough for a person to enter the system in the event servicing of a module is required.

For example, such systems are manufactured of concrete with a reinforced steel core, or interconnecting pipes or chambers constructed of metal or plastics supported by a structural stone bedding and backfill material or ponds with an open water surface.

There are various existing designs of water storage and controlled outflow systems that are known in the art. These systems, while being designed to retain and detain water and/or displace water, however, have significant disadvantages that are overcome by the presently described invention.

U.S. Pat. No. 7,621,695 to Smith et al. discloses a subsurface cubic water system having modules with pillars forming a generally cruciform cross section. U.S. Pat. No. 7,344,335 to Burkhart discloses a water retention system having modules with continuous lateral and longitudinal channels, the continuous lateral and longitudinal channels extending from one end of the system to the other allowing for unimpeded flows in any or all directions during operations.

U.S. Pat. Nos. 7,056,058, 6,779,946 and 5,810,510 to Urriola et al. disclose a transport corridor drainage system having vertical channels and no horizontal deck. The '510 patent in particular discloses an underground drainage system having channels for flow.

U.S. Pat. No. 5,249,887 to Phillips discloses an apparatus for control of liquids having modules in series; U.S. Patent Application No. 2009/0226260 to Boulton et al. discloses a method and apparatus for capturing, storing and distributing water; and U.S. Patent Application No. 2009/0279953 to Allard et al. discloses modular units having an arched opening in each of six faces, such that passages for water flow extend through the center of the structure to each opposing face.

All of these designs, however, while being designed for the storage of water and function as large holding vessels for water, do not provide a system that is designed for providing indirect flow of water internally within a system. Furthermore, these systems do not disclose the use of a modular system having beams, walls and/or weirs, the modular system allowing for a serpentine or semi-serpentine flow of water within the modules and system.

Instead, existing systems have primarily functioned as large holding vessels for water, with treatment and flow control devices occurring outside of the system structure. Existing systems do not apply and integrate the principles of treatment or internal flow control methods that affect the velocity, the potential energy (head), time attenuation (retention) flow and/or turbulence control within the system. Flow controls, such as weirs, baffles, walls, orifices, standpipes and particular intended combinations of these devices, have not been provided internally in the existing systems. Furthermore, existing systems have not used these flow controls to cause water to purposely flow indirectly internally within the system for a means of secondary application such as treatment or conditioning.

Indirect flow of water internally within storage with controlled outflow systems has advantages over existing systems. Such a design allows for water to flow through a system for a controlled period of time. Indirect flow of water internally through a storage and controlled outflow system allows for the amount of time that water is present within the system to be optimized based upon the cross-sectional area of the system (i.e., the water stays in the system for the optimal amount of time based on the cross-sectional area of the system). This allows the water to be controlled within the system and also allows for water to accumulate in the system in a controlled and systematically intended manner. This allows for optimal increased storage of water in the system and the application of controlling the flow for other purposes such as treatment, temperature regulation, flow attenuation, and other purposes for water treatment and conditioning.

Indirect flow of water internally within a retention and detention system also allows the water to be controlled within the system to achieve treatment. This allows the water to be treated or conditioned as the water flows internally within the system. A system with a purposely intended controlled indirect flow, prepares the proper environment and conditions conducive to treatment and conditioning applications. Such an intended system design can create the optimum conditions for gravity separation (allowing for both oil water separation and particle separation), neutrally buoyant materials control, trash, debris and solids control, filtering, extended detention for nutrient reduction, temperature reduction, and chemical addition. The result of such a system design may be for the use of conditioning process water or for the removal of various components (either soluble or insoluble) from the flow regime prior to the water being discharged from the system. Furthermore, indirect flow of water internally within a system has other advantages as it allows for compartmentalized flow within the system that allows for various configurations and interchangeability of applications of the system to be provided.

Additionally, indirect flow of water internally within a system may allow for systems where one compartment of the system has a solid floor, while other compartment of the system has a permeable or gravel floor, allowing water to exit the system through the bottom. This may allow for one compartment of the system to be used for water retention, while having other compartments of the system used for water treatment or other applications. In short, a system with internal indirect flow of water is desirable as it solves problems related to uncontrolled flow, such as "short circuiting", that is common in existing systems. Moreover, internal indirect flow of water solves problems that have not been recognized in the prior art, as it requires the use of beams or other such diversionary structures that diverts the water in an indirect manner. These additional beams and/or material for diverting the water in an indirect manner involves creating systems with additional cost as extra concrete and/or other material used to divert water has to be supplied as material costs.

A system incorporating beams is also more flexible then existing systems as the beams allow for control of the water directing it into a "low flow channel" formed by the restrictive nature or the beam as a barrier and a function of the cross sectional area of the water surface area below the level of the beam. As a result of this concept, for a given period of time greater amounts of water may remain in the system with the beam design, allowing for an increased detention capacity of the system for its available storage volume. The increase in detention time is a direct result of the extended attenuation time (or flow lagging) caused by the indirect serpentine flow pattern allowing for the water to remain in the system for a longer period of time.

As none of these existing systems provide for a design having indirect flow, it is desirable to provide a design that achieves these objectives, and achieves the advantages of such a system. It is further desirable to provide a modular system that hinders the flow of water in a lateral direction, while allowing for longitudinal flow. It is further desirable to provide a modular system that hinders the flow of water in a longitudinal direction, while allowing for lateral flow.

It is also desirable to provide a system that allows for serpentine or semi-serpentine flow of water in the system and allows for control of the flow of water. It is further desirable to provide for a system that allows for internal treatment and conditioning applications of water and also allows for storage and controlled discharge of water. It is also desirable to provide a system that allows for optimal treatment of the water.

Such a water storage with controlled outflow system is novel and unobvious over the prior art. Existing systems have not recognized the problems associated with controlling "short circuiting" by establishing the indirect flow of water through a system where the level of the water is controlled by the height of the beams, walls or weirs. Such existing systems, and persons of skill in the art making such systems, would not have recognized the problem of having indirect flow as all of the existing systems simply are designed principally to store water and work to move the water through the system directly or work to retain water. Existing systems are not designed to control the flow of water in an indirect manner and to maximize treatment of the water.

Having systems with beams may allow for internal indirect flow when the level of the water is below the level (or top of the vertical height) of the beams in the system. In occasions where the level of water is higher than the top of the vertical height of the beams, such as a 2, 10, 25, 50 or even 100 year storm, it is advantageous to have beams as the system may then allow for flow of water that is unimpeded in all directions. This is advantageous over having impervious walls instead of beams, as water would not be able to pass thru the walls. However, a system incorporating impervious walls is also contemplated by the disclosure and utilized specifically when an impeded barrier is required for an application purpose.

A system that has internal indirect flow achieves both storage and controlled outflow capabilities, while allowing for treatment of water, and allowing for water to move through the system in an indirect manner, which optimizes by attenuation (or flow lagging) the amount of time the water is retained in the system. A system that achieves these objects, such as described below, is certainly desirable. Furthermore, a system that controls the velocity, the potential energy (head), time attenuation (flow lagging), flow and turbulence internally within a system is also desirable. A system that has a positive impact on the environment is also desirable.

SUMMARY OF THE INVENTION

Accordingly, it is an object of the present invention to provide a structural system that has indirect flow of water internally within the system. Water as discussed in this application may refer to stormwater, groundwater, drinking water, irrigation water, sewerage and wastewater, or industrial process water. Water may also refer to dirty water and water with various other materials, impurities and/or constituent characteristics such as temperature associated with the water type.

It is another object of the invention to provide a system that hinders the flow of water in a lateral direction, while allowing for the flow of water in a longitudinal direction, when the level of the water is below the level or vertical height of the beams. It is also an object of the invention to provide a system that hinders the flow of water in a longitudinal direction, while allowing for the flow of water in a lateral direction, when the level of the water is below the level or vertical height of the beams. It is an object of the invention to control the flow of water when the water is below the height of the beams.

It is another object of the invention to provide a system that allows for serpentine or semi-serpentine flow of water within the system. It is another object of the invention to provide a system where the water enters the system and progresses in a serpentine or semi-serpentine manner within and around the system. There are advantages to this design as it allows for the intended optimization of the amount of time the water is present within the system (attenuation or retention) as a function of the cross-sectional area and length of the flow channel within the system. Other advantages of this design allow for the water to be controlled and treated as it progresses within the system.

It is another object of the invention to provide a system that allows for flow control of water and for treatment of water. It is another object of the invention to provide for a system that allows for storage and controlled outflow of water. It is another object of the invention to provide a modular system made from various separate modules with different design intentions, but integral to the overall function of the management system. It is recognized that there are fluid dynamic hydraulic similarities between applications that are incorporated in and a reflection of the indirect flow capabilities of the system.

It is another object of the invention to integrate treatment and flow controls into modules which affect and take advantage of the velocity, the potential energy (head), time attenuation (retention), flow and or turbulence control of the fluid within the system.

It is another object of the invention to provide a system that has a positive impact on the environment. It is an object of the invention to provide a smaller environmental footprint than existing systems. It is an object of the invention to have more optimal use of the area of the system via its geometry than existing systems.

These and other objectives are achieved by providing a modular system for controlling a flow of water comprising: a plurality of modules, at least some of the plurality of modules comprising a horizontal deck supported by four vertical members, each of the four vertical members having a bottom edge, the plurality of modules being arranged in a grid having an x-axis and a y-axis, the plurality of modules forming: one or more longitudinal channels, the one or more longitudinal channels being defined in the direction along the y-axis of the modular system, and one or more lateral channels, the one or more lateral channels being defined in the direction along the x-axis of the modular system, wherein at least some of the plurality of modules have at least one beam extending across from one of the vertical members to another one of the vertical members of one of the modules, wherein the at least one beam extends partially upwards from the bottom edge of the one of the four vertical members towards the horizontal deck thereby creating a window.

The system may have the at least one beam direct the flow of the water when the level of the water is below the level or top of the vertical height of the beam. The vertical height of the beam extends from the bottom of the floor up towards the horizontal deck. The beam height is preferred to be approximately 12 inches from the floor or ground, when modules are preferred to be approximately 5 feet, 8 inches. However, the beam height may be adjusted in various embodiments of the invention and may be greater than or less than 12 inches in embodiments of the invention.

The system may control the flow of the water in an indirect path. An indirect path is defined as a path that is not in a straight line. Such a path may be a path that changes direction, such as allowing the water to travel in a longitudinal direction across a module and then being diverted to go in a lateral direction across another module, and vice-versa.

The system may have the plurality of the modules be stackable. Such a stackable design, allows for the system to have various levels. The system may have one, or two, or even more module levels. Such a system with more than one level is referred to a multilevel system. Stackable multilevel systems have modules that are adapted to be stacked. Such modules have structural indentations on the top of the modules that allow for the legs of other modules to be stacked upon them. Such indentations are adapted to receive the legs of other modules. In addition a lower module may or may not have an impervious deck system, an opening to allow for vertical water flow or a flow control device between layers for the intentions of controlling flow as a purposeful design.

The system may also provide for uninterrupted flow across the one or more of the longitudinal channels. The system may provide for uninterrupted flow across the one or more of the lateral channels. Uninterrupted flow is flow through a module that is not interrupted by a beam. A beam is an example of an element that causes the flow of the water to be interrupted. A wall is another example of an element that causes the flow of the water to be interrupted. Other such elements may cause the flow of the water to be interrupted.

The system may have at least some of the plurality of modules be located on the external edge of the system defining a perimeter. The system may have the perimeter of the plurality of modules be perforate. Perforate is defined as allowing for water to travel through the wall of the module via holes. The holes that allow for the wall to be perforate may be of various diameters. Typically, such holes have a diameter of approximately 1-4 inches in diameter, but are sized based on an intended controlled flow rate.

The system may have a porous surface on the bottom of the system, the plurality of modules being located on the porous surface. The porous surface may be made from gravel or other such materials that allow for the water to seep through the surface.

The system may also be located on an impermeable surface. The impermeable surface may be a material such as concrete or another material that water cannot easily travel through.

The system may have certain modules be located on a permeable surface, while other modules are located on an impermeable surface.

The system may further have at least one inlet and at least one outlet for the water to enter or exit the system in a controlled flow rate. Infiltration of the water through pervious base or perimeter materials shall be considered a type of outlet device. As would a mechanic device such as a pump or siphon device be considered a type of outlet device incorporated in the system. The system may have more than one inlet and more than one outlet. Such an inlet or outlet may be an orifice or a standpipe. An orifice is defined as a type of opening or aperture having a pipe or tubing connected to the opening allowing for the water to enter or exit the system at a purposefully designed controlled flow rate.

The system may also comprise corner modules, the corner modules each having two of the four vertical members attached to one another via walls, the walls extending from the bottom of the horizontal deck to the bottom of the vertical members and across the entire length of one edge of the horizontal deck; end modules, the end modules each having a single beam and a single wall, the single beam extending from the one of the four vertical members to another one of the four vertical members wherein the single beam extends partially upwards from the bottom edge of the one of the four vertical members towards the horizontal deck thereby creating a window, and wherein the single wall extends from the bottom of the horizontal deck to the bottom of the vertical members and across the entire length of one edge of the horizontal deck; and internal modules, the internal modules each having two beams, each of the two beams extending from the one of the four vertical members to another one of the four vertical members, wherein the two beams extend partially upwards from the bottom edge of the one of the four vertical members towards the horizontal deck thereby creating two windows.

The system may have each of its beams integrated together with their corresponding vertical members. Such an integrated structure may have the beams and corresponding vertical members be fused together as one piece. In certain embodiments, the beams and corresponding vertical members may be manufactured together as one piece during the construction of the modules. In other embodiments, the beams and corresponding vertical members may be manufactured as separate pieces which are integrated together using various industry techniques.

The system may have each of the beams direct the flow of the water when the level of the water is below the level or vertical height of each of the beams (i.e., when the water is below the maximum height of the beams). When the level of the water is greater than the beam height, then the water may travel over the beams. This typically will happen per purposeful design intent, such as in a 2, 10, 25, 50 or 100 year storm.

The system may have its walls perforated with holes. These holes may allow the water to flow through the holes. Such walls with holes that allow for the water to travel through them are defined as being perforate.

The system may have modules, which contain an inlet or an outlet, also be nonperforate. Nonperforate is defined as not letting water through. A solid wall is an example of a nonperforate wall. Nonperforate walls may exist having an opening, inlet or outlet (such as an orifice), which will allow water to enter or exit the system through the opening, inlet or outlet.

The system may have at least some of the modules have at least one such opening or orifice. The system may have modules that are nonperforate also have a weir to allow the flow of water out of the modules. The modules with nonperforate walls may be located on an impermeable surface. The system may have modules have weirs, baffles, beams, orifice holes, and particular combinations of these elements that are used to control the flow of water internally within the system. A completely enclosed module consisting of a watertight storage space (with #4 non-perforated walls and an impervious floor) may be used as an isolation chamber capable of watertight containment integrated into the system.

Other objectives of the invention are achieved by providing a module for controlling a flow of water comprising: a horizontal deck; four vertical members each having a bottom edge, the four vertical members supporting the horizontal deck and being arranged in the four corners below the horizontal deck; a first beam extending across from the one of the four vertical members to another one of the four vertical members, wherein the first beam extends partially upwards from the bottom edge of the one of the four vertical members towards the horizontal deck. The first beam is typically provided as having its upper surface be parallel to the horizontal deck. In other embodiments, the first beam may have its upper surface be approximately parallel to the horizontal deck and/or may have its upper surface be angled with respect to the horizontal deck.

The module may have the first beam form a window between the top of the beam and the bottom of the horizontal deck. Such a window may have various shapes. However, the window does not involve having the module have more concrete above the beam than the beam itself. The window is different than a weir, as the window is formed based upon the beam, not based upon cutting a hole in a solid wall. A hole is a solid wall is defined as being an opening. A window, is not simply an opening, but rather is the open area from the top of the beam to approximately the bottom of the horizontal deck. The window does not extend all the way up to the bottom of the horizontal deck. There is a structural section a few inches wide between the deck and the top of the window opening.

The module may have the first beam direct the flow of the water when the water is below the top of the vertical height of the first beam. The first beam may allow the water to flow indirectly through the module and/or system.

The module may have one of the vertical members be attached to another one of the vertical members via a first wall, the first wall extending from the bottom of the horizontal deck to the bottom of the vertical member and across the entire length of one edge of the horizontal deck. The module may have the wall have perforated holes.

The module may have a second beam extending across from the one of the four vertical members to another one of the four vertical members. The second beam may extend partially upwards from the bottom edge of the one of the four vertical members towards the horizontal deck.

The second beam may form a window between the top of the second beam and the bottom of the horizontal deck. The second beam may direct the flow of the water when the level of the water is below the top of the vertical height of the second beam (i.e., below the beam height).

The module may have the first beam be integrated together with two of the four vertical members it extends across. The module may have the second beam be integrated together with two of the four vertical members it extends across. The beam may be manufactured with the vertical members as one piece or may be separate pieces that are connected together using conventional techniques known in the industry. The module may be stackable. Such modules have indentations on the top of the modules that allow for the legs of other modules to be stacked upon them. The module may form at least one channel through the module. The module may have a structural component with a storage capacity. The module may made of a steel core within the module and be reinforced by concrete.

Other objectives of the invention are achieved by providing a method for controlling a flow of water in a modular system comprising: providing a plurality of modules, each of the plurality of modules comprising: a horizontal deck supported by four vertical members, the plurality of modules being arranged in a grid having an x-axis and a y-axis, the plurality of modules forming one or more longitudinal channels, the one or more longitudinal channels being defined in the direction along the y-axis of the modular system, one or more lateral channels, the one or more lateral channels being defined in the direction along the x-axis of the modular system; and wherein the at least some of the plurality of modules have at least one beam extending from the one of the four vertical members to another one of the four vertical members, wherein the at least one beam extends partially upwards from the bottom edge of the one of the four vertical members towards the horizontal deck thereby creating a window; inserting the water into the plurality of modules by natural or artificial means, wherein the water is directed through the system by the at least one beam in the plurality of modules, wherein the at least one beam directs the flow of the water when the water is below the level or vertical height of the beam.

The water in the method may be routed through the modular water system in a serpentine or semi-serpentine manner. A serpentine or semi-serpentine manner involves the water flowing in a snakelike fashion where the water may travel through various modules in one direction and then turn and travel in a different direction which may be different and/or opposite to the original direction. Travelling in a serpentine or semi-serpentine manner involves having the water change directions at least once as it travels through the system.

In other embodiments, the water may travel in a single or double row system (such that the beam hinders movement of the water laterally while allowing it to move longitudinally). In these embodiments, the water may not move in a serpentine or semi-serpentine manner.

Other objectives of the invention are achieved by providing a modular system for controlling a flow of water comprising: a plurality of modules, at least some of the plurality of modules comprising a horizontal deck supported by four vertical members, the plurality of modules being arranged in a grid having an x-axis and a y-axis, the plurality of modules forming: one or more longitudinal channels, the one or more longitudinal channels being defined in the direction along the y-axis of the modular system, and one or more lateral channels, the one or more lateral channels being defined in the direction along the x-axis of the modular system, wherein the modular system provides for serpentine flow through the longitudinal and lateral channels.

The modular system may provide for serpentine flow because of a plurality of horizontal beams that direct the flow of the water when the level of the water is below the top of the vertical height of each of the plurality of horizontal beams. When the water flows into the beams, the water is diverted into a different direction.

The modular system may have various internal flow controls, such as weirs, baffles, walls, beams, orifice holes, and particular combinations of these devices. Such internal flow controls are used to control the internal flow of the system so it has indirect flow.

Other objects of the invention and its particular features and advantages will become more apparent from consideration of the following drawings and accompanying detailed description. It should be understood that the detailed description and specific examples, while indicating the preferred embodiment of the invention, are intended for purposes of illustration only and are not intended to limit the scope of the invention.

DETAILED DESCRIPTION OF THE INVENTION

Figure 1:
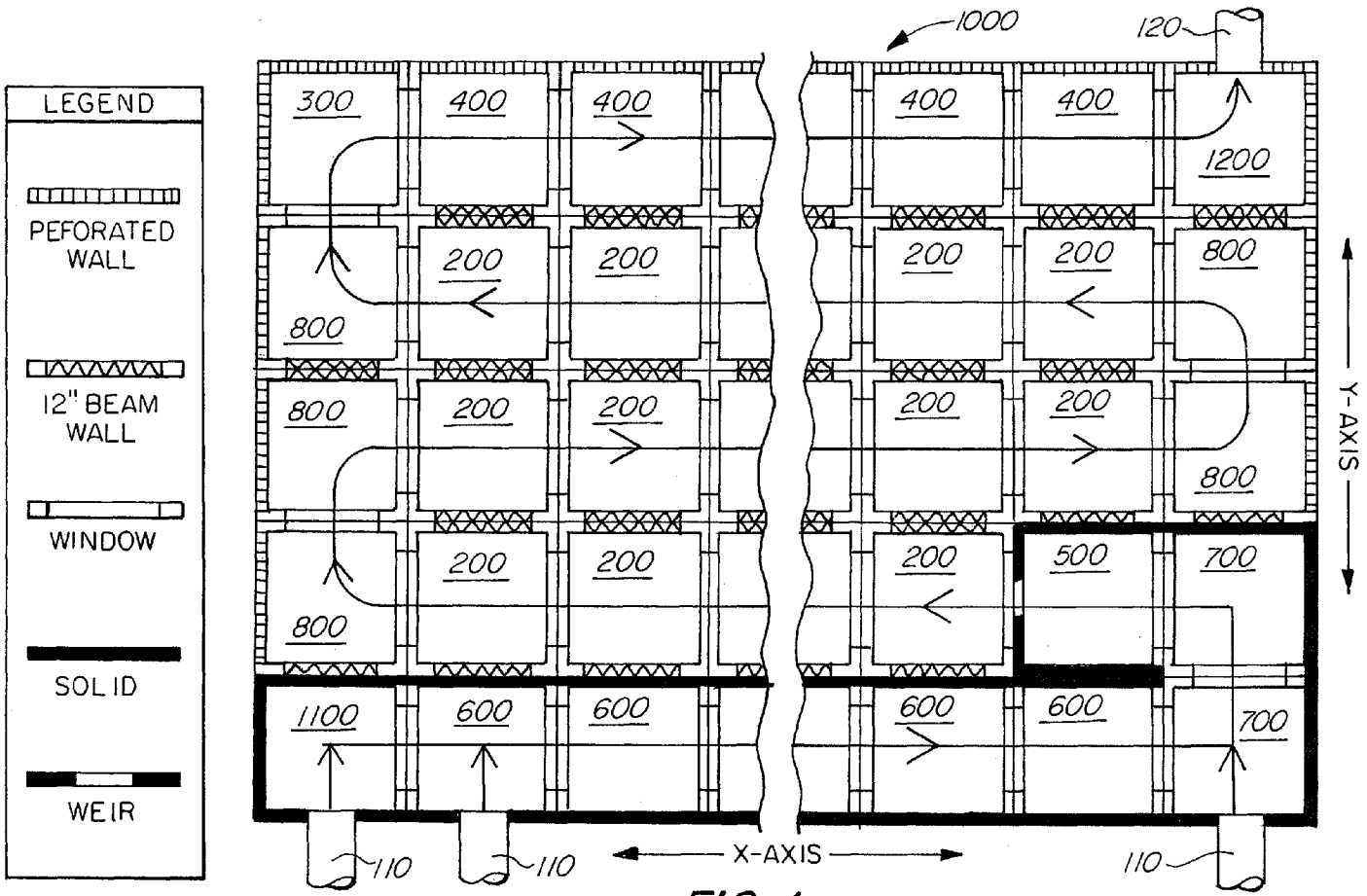
FIG. 1 is a grid view of an embodiment of the system.

Referring to FIG. 1, storage and control outflow system 1000 is shown. System 1000 is made of various modules and is an example of an embodiment of the system disclosed by the present invention. System 1000 is shown having three inlets 110 and one outlet 120. However, there may be more inlets or less inlets 110 and outlets 120 for system 1000 than shown in FIG. 1. System 1000 has a legend on the left of the system showing what FIG. 1 and FIGS. 10 and 10A mean by a perforated wall, 12" beam wall, window, solid wall and weir. System 1000 also has an x-axis as shown (lateral direction) and y-axis (longitudinal direction), which shows the flow of the water through the system in lateral and longitudinal channels, respectively.

System 1000 also has arrows through the system that show the direction of the flow of water within the system. This is an example of a serpentine flow of the water as the arrows show that the water travels in a snakelike manner through the system, where the flow of water changes direction at least once. System 1000 also reduces the turbulence the water as the water changes direction.

System 1000 achieves the advantages of the present invention. Such advantages involve achieving indirect flow of the water internally within system 1000, which is advantageous over existing systems. System 1000 allows for the water to flow through system 1000 for a controlled period of time. System 1000 may allow water to be treated by a treatment system and method as the water flows within system 1000. Such a treatment system may filter the water, removing various components of the water from the system prior to the water exiting the system. Such a treatment system may be present in various modules of system 1000.

System 1000 also allows for the optimization of the amount of time that the water is present within system 1000 based upon the cross-sectional area of the system. This allows for the water to accumulate in system 1000 in a controlled and systematic manner. This allows for increased storage of the water in system 1000. Moreover, greater amounts of the water may be in system 1000 at a given time, as it has 12 inch beams, allowing for increased storage and retention capacity of the system per its cross-sectional area. If the beam height is increased, the system is able to retain more water per cross-sectional area at a given time.

Dimensions of system 1000 are shown as having 12 inch beams (12 inches being the beam height); however, beams with other heights may be used in the system, such as having beams that have a height of greater than 12 inches. System 1000 is made of various modules. Modules typically are approximately 8 feet wide and 8 feet deep and have a height of 5 feet 8 inches when employing 12 inch beams. The beam height to height of the module ratio thus is typically 1:8.5. However, the ratio of height of the module to beam height may vary depending upon the system and can range from 1:3-1:20. Modules can also have a height that ranges from 3 feet to a height of 12 feet. Modules less than 3 feet are difficult to work with as it is difficult for a man to enter a smaller module to service it.

Furthermore, modules typically have the ability to support 10,000 to 14,000 pounds of weight. However, modules may support additional weight based on materials used, such as having a steel frame internal to the concrete outer shell. Modules may be made of other materials known in the art, and may be made of materials that are more expensive and have greater load bearing capabilities, if desired.

System 1000 has modules having two perforated walls, such as module 300; modules having one perforated wall and one beam, such as module 400 and module 800; and modules having two beams, such as module 200.

System 1000 also has modules that have two or more solid walls, such as module 600, module 700 and module 1100 (with 3 solid walls); and modules that have two solid walls and a weir, such as module 500. System 1000 may be located on a solid surface, which is impermeable. System 1000 may be located on a permeable surface, such as crushed granite. The system may have certain modules located on a permeable surface and may have other modules located on a solid impermeable surface such as concrete. Preferably, modules 500, 600, 700 and 1100 are located on an impermeable surface. These modules typically have a floor which is impermeable. Preferably, modules 200, 300, 400, 800, and 1200 are located on a permeable surface. However, various modules can be arranged on various surfaces and or materials.

Figure 2A:
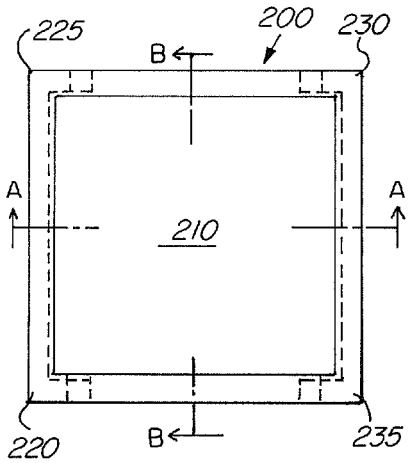
FIG. 2A is a top view of the module of FIG. 2.
Figure 2:
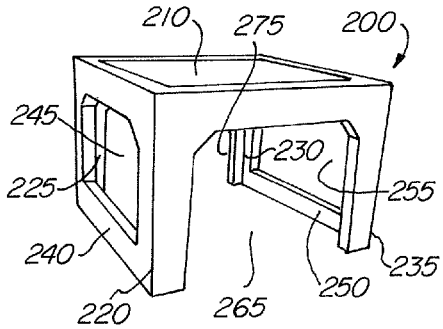
FIG. 2 is a perspective view of a module of the system of FIG. 1.

FIG. 2 shows one type of module in system 1000. Module 200 is shown having four legs 220, 225, 230 and 235. Four legs 220, 225, 230 and 235 support horizontal deck 210. Each of the four legs 220, 225, 230 and 235 has a bottom edge.

Legs 220 and 225 are connected together via beam 240. Legs 230 and 235 are connected together via beam 250. Beams 240 and 250 are preferably about 12 inches in height from the bottom edge to the top of the beam. The height of the module 200 is preferably 5 feet 8 inches.

Beams 240 and 250, however, may vary in height to be more or less than 12 inches in height from the bottom edge to the top of the beam. Beams 240 and 250 are used to control the flow of the water so that it moves in an indirect manner within the system. Beams 240 and 250 are also used, to allow the water to flow around the system in a serpentine or semi-serpentine manner.

FIG. 2 also shows window 245 formed in the space between beam 240 and horizontal deck 210 and window 255 formed in the space between beam 250 and horizontal deck 210. Module 200 also has a channel which extends through the module from 265 to 275. Channel 265/275 allows for the water to flow uninterrupted within module 200. The height of the channel 265/275 is preferably 4 feet 6 inches when using a module with a height of 5 feet 8 inches; however this may vary in various embodiments. The ratio of the height of the channel to the height of the module ranges from 1:2 to 4:5. Such dimensions are applicable to all modules described in the system.

Moreover, channel height may vary within various modules as the height of the floor may vary. However, typically the channel has a standard cross-sectional area through the channel. Such a cross-sectional area is approximately the same within various modules in a system.

Figure 2B:
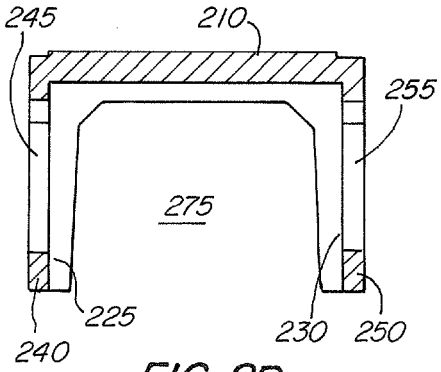
FIG. 2B is a cross section view of FIG. 2 taken along axis A-A.
Figure 2C:
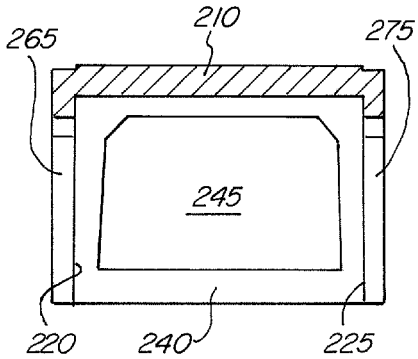
FIG. 2C is a cross section view of FIG. 2 taken along axis B-B.

FIGS. 2A, 2B and 2C show various views of module 200. FIG. 2A provides a top view where axes A-A and B-B are shown. FIG. 2B is a view across axis A-A where channel 275/265 is shown. Legs 225 and 230 are also shown in this view as well as beam 240 and beam 250 and window 245 and window 255. FIG. 2C is a view across axis B-B where beam 240 and window 245 are shown as well as legs 220 and 225.

Figure 3A:
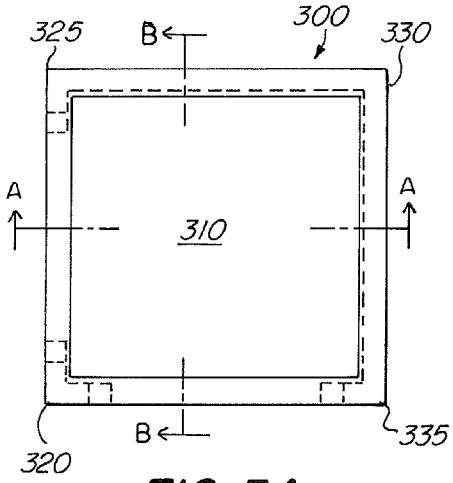
FIG. 3A is a top view of the module of FIG. 3.
Figure 3:
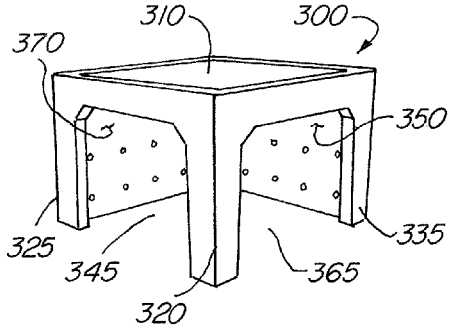
FIG. 3 is a perspective view of a module of the system of FIG. 1.

FIG. 3 shows another type of module in system 1000. Module 300 is shown having four legs 320, 325, 330 and 335. Four legs 320, 325, 330 and 335 support horizontal deck 310. Each of the four legs 320, 325, 330 and 335 has a bottom edge.

Legs 325 and 330 are connected together via wall 370. Legs 330 and 335 are connected together via wall 350. Wall 370 and wall 350 are shown as having perforations 380. Perforations 380 allow for the water to exit the system. Perforations may be holes that have a minimum diameter of one inch. The holes may be larger than one inch; however, holes and perforations are smaller than the openings defined in this invention.

FIG. 3 also shows channels 345 and 365 formed in the space between the bottom edges of the four legs to the underside of horizontal deck 310. Channels 345 and 365 allow for the water or fluid to flow through module 300. As shown the entrance way of channel 345, there is a height of the channel from the bottom of the floor to the underside of the deck. However, the underside of the deck may have a greater height to the floor in the middle of the module than the height of bottom of the floor to the underside of the deck in the channel opening.

Figure 3B:
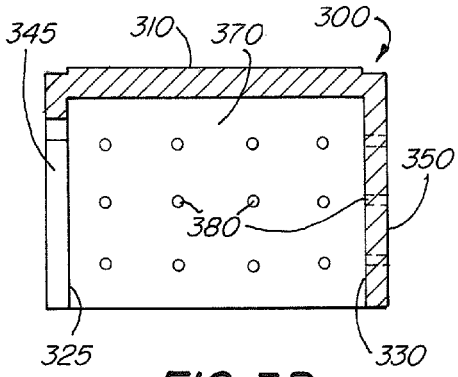
FIG. 3B is a cross section view of FIG. 3 taken along axis A-A.
Figure 3C:
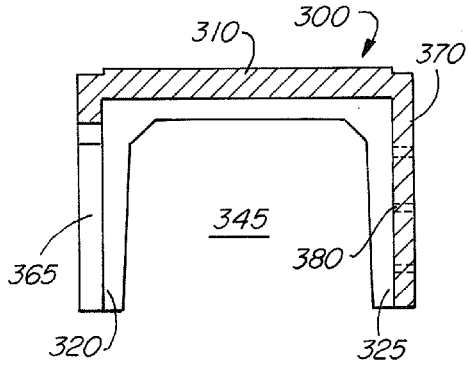
FIG. 3C is a cross section view of FIG. 3 taken along axis B-B.

FIGS. 3A, 3B and 3C show various views of module 300. FIG. 3A provides a top view where axes A-A and B-B are shown. FIG. 3B is a view across axis A-A where wall 370 is shown. Legs 325 and 330 are also shown in this view as well as channel 345 and wall 350. FIG. 3C is a view across axis B-B where channel 345 is shown.

Figure 4A:
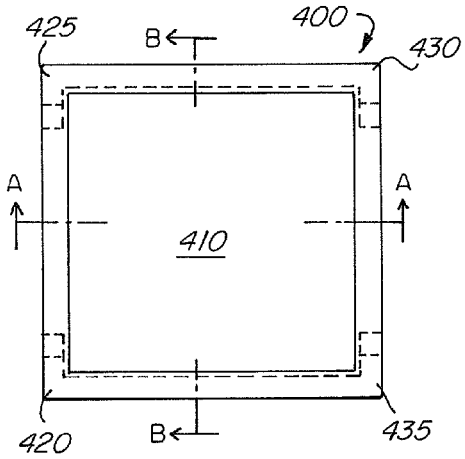
FIG. 4A is a top view of the module of FIG. 4.
Figure 4:
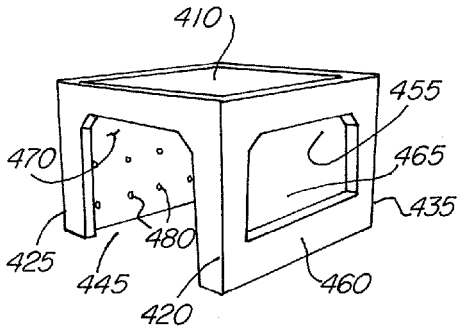
FIG. 4 is a perspective view of a module of the system of FIG. 1.

FIG. 4 shows another type of module in system 1000. Module 400 is shown having four legs 420, 425, 430 and 435. The four legs 420, 425, 430 and 435 each support horizontal deck 410. Each of the four legs 420, 425, 430 and 435 has a bottom edge.

Legs 420 and 435 are connected together via beam 460. Legs 425 and 430 (hidden from FIG. 4) are connected together via wall 470. Beam 460 is preferably about 12 inches in height or greater from the bottom edge to the top of the beam. Beam 460 is used to control the flow of the water so that it moves in an indirect manner within the system. Beam 460 is also used to allow the water to flow around the system in a serpentine manner. Wall 470 has perforations 480. Perforations 480 may allow for the water to exit the system. Perforations 480 typically have a diameter of a few inches.

FIG. 4 also shows window 465 formed in the space between beam 460 and horizontal deck 410. Module 400 also has a channel 445 which extends through the module from 445 to 455. The channel 445/455 allows for the water to flow uninterrupted through module 400.

Figure 4B:
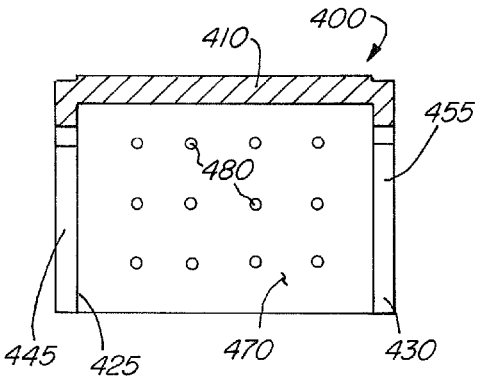
FIG. 4B is a cross section view of FIG. 4 taken along axis A-A.
Figure 4C:
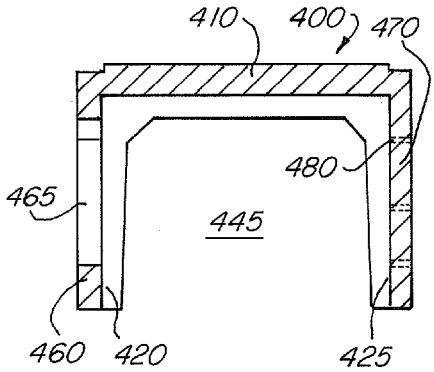
FIG. 4C is a cross section view of FIG. 4 taken along axis B-B.

FIGS. 4A, 4B and 4C show various views of module 400. FIG. 4A provides a top view where axes A-A and B-B are shown. FIG. 4B is a view across axis A-A where wall 470 is shown. Legs 425 and 430 are also shown in this view. FIG. 4C is a view across axis B-B where channel 445/455 is shown.

Figure 5:
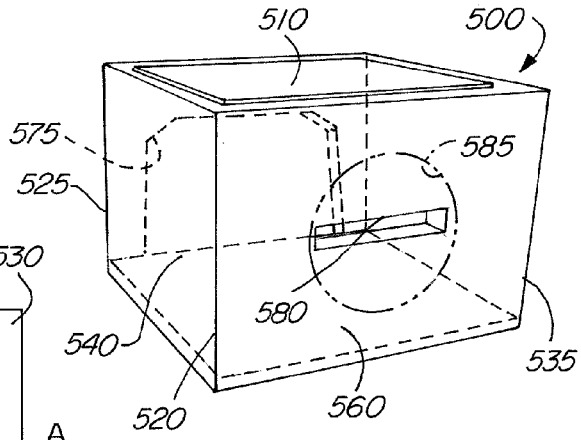
FIG. 5 is a perspective view of a module of the system of FIG. 1.

FIG. 5 shows another type of module in system 1000. Module 500 is shown having four legs 520, 525, 530 and 535. The four legs 520, 525, 530 and 535 each support horizontal deck 510. Each of the four legs 520, 525, 530 and 535 has a bottom edge. Each of the four legs 520, 525, 530 and 535 is supported by floor 590. Floor 590 is shown as being a solid impermeable floor.

Legs 520 and 525 are connected together via wall 540. Legs 530 and 535 are connected together via wall 550. Legs 520 and 535 are connected together via wall 560. Walls 540, 550 and 560 are shown as solid walls.

FIG. 5 also shows channel 575 formed in the space between floor 590 and the underside of horizontal deck 510. Channel 575 allows for the water to flow through the module. FIG. 5 also has either weir 580 or opening 585. Opening 585 allow an inlet or outlet to be connected to the module (such as inlet 110 or outlet 120 shown in FIG. 1). If a weir 585 is provided, an inlet or outlet is typically not attached.

Figure 5A:
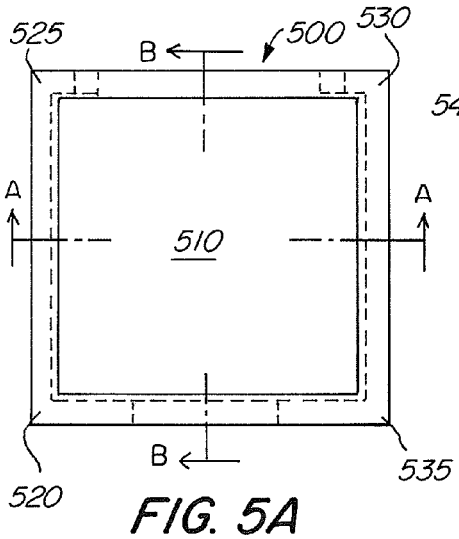
FIG. 5A is a top view of the module of FIG. 5.
Figure 5B:
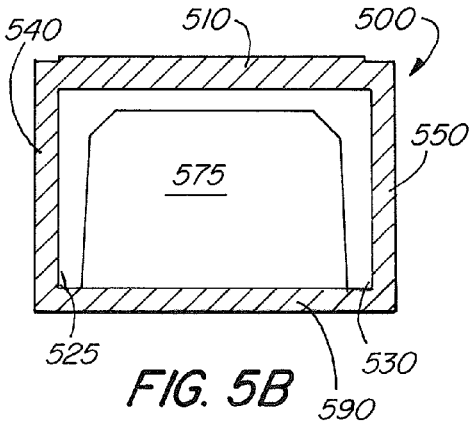
FIG. 5B is a cross section view of FIG. 5 taken along axis A-A.
Figure 5C:
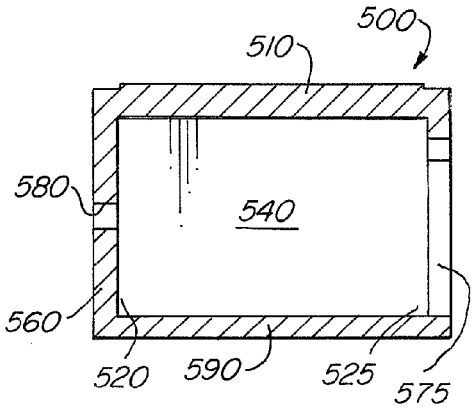
FIG. 5C is a cross section view of FIG. 5 taken along axis B-B.

FIGS. 5A, 5B and 5C show various views of module 500. FIG. 5A provides a top view where axes A-A and B-B are shown. FIG. 5B is a view across axis A-A where channel 575 is shown. Legs 525 and 530 are also shown in this view. FIG. 5C is a view across axis B-B where wall 540 is shown.

Figure 6A:
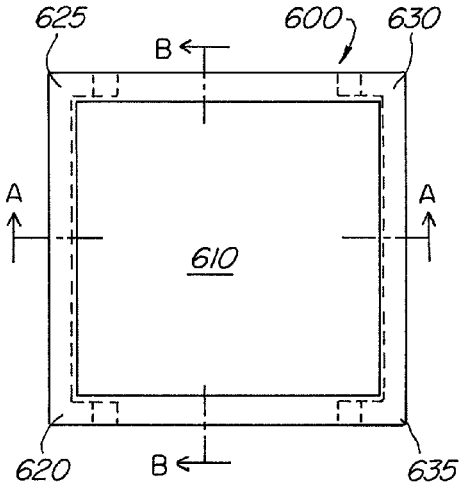
FIG. 6A is a top view of the module of FIG. 6.
Figure 6:
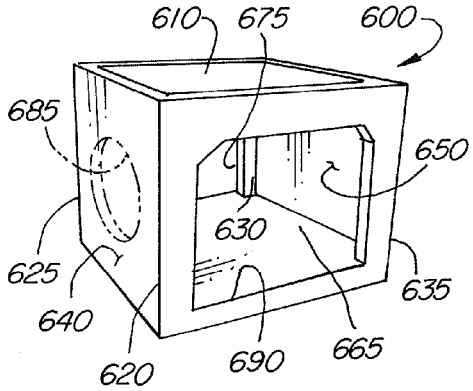
FIG. 6 is a perspective view of a module of the system of FIG. 1.

FIG. 6 shows another type of module in system 1000. Module 600 is shown having four legs 620, 625, 630 and 635. The four legs 620, 625, 630 and 635 each support horizontal deck 610. Each of the four legs 620, 625, 630 and 635 has a bottom edge. These legs are supported on a floor 690. Preferably, floor 690 is impermeable.

Legs 620 and 625 are connected together via wall 640. Legs 630 and 635 are connected together via wall 650. Walls 640 and 650 are shown as solid walls. Wall 640 may have an opening 685 attached to the wall. This opening 685 may allow an inlet or outlet to be connected to the module (such as inlet 110 shown in FIG. 1). Such an opening 685 is optional to module 600.

FIG. 6 also shows channel 665 formed in the space between the floor 690 and the underside of horizontal deck 610. FIG. 6 also shows channel 675 formed in the space between floor 690 and the underside of horizontal deck 610. The channel height may vary in the module shown in FIG. 6. Channel 675 allows for the water to flow through the module and is connected to channel 665 forming channel 665/675.

Figure 6B:
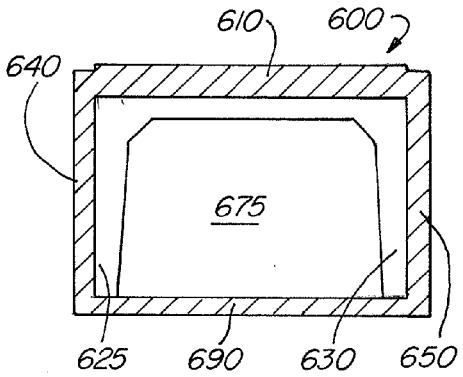
FIG. 6B is a cross section view of FIG. 6 taken along axis A-A.
Figure 6C:
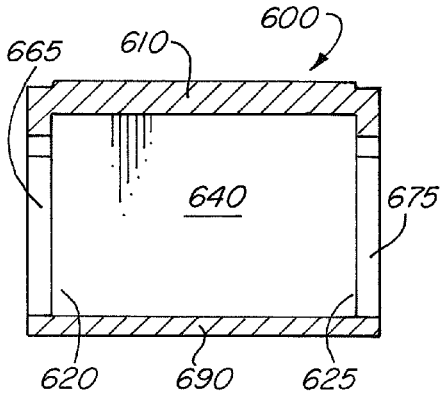
FIG. 6C is a cross section view of FIG. 6 taken along axis B-B.

FIGS. 6A, 6B and 6C show various views of module 600. FIG. 6A provides a top view where axes A-A and B-B are shown. FIG. 6B is a view across axis A-A where channel 665/675 is shown. Legs 625 and 630 are also shown in this view. FIG. 6C is a view across axis B-B where wall 640 is shown.

Figure 7A:
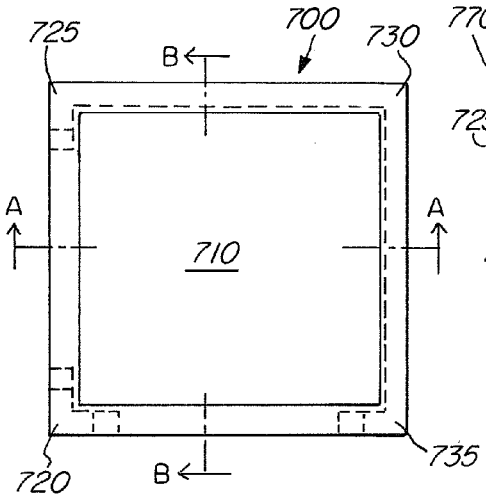
FIG. 7A is a top view of the module of FIG. 7.
Figure 7:
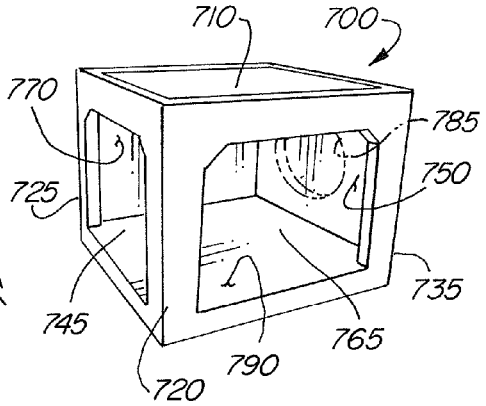
FIG. 7 is a perspective view of a module of the system of FIG. 1.

FIG. 7 shows another type of module in system 1000. Module 700 is shown having four legs 720, 725, 730 and 735. The four legs 720, 725, 730 and 735 each support horizontal deck 710. Each of the four legs 720, 725, 730 and 735 has a bottom edge. These legs are supported on a floor 790. Preferably, floor 790 is impermeable.

Legs 725 and 730 are connected together via wall 770. Legs 730 and 735 are connected together via wall 750. Walls 770 and 750 are shown as solid walls. Wall 750 may have an opening 785. This opening 785 may allow an inlet or outlet to be connected to the module (such as inlet 110 shown in FIG. 1). Such an opening 785 is optional to module 700, FIG. 7 also shows channel 765 formed in the space between floor 790 and the underside of horizontal deck 710. Channel 765 allows for the water to flow through module 700. FIG. 7 also shows channel 745 formed in the space between floor 790 and the underside of horizontal deck 710. Channel 745 allows for the water to flow through module 700 and is connected to channel 765. Channels 745 and 765 may have various heights as the channel height in the center of module 700 is greater than the channel height as the edge of module 700.

Figure 7B:
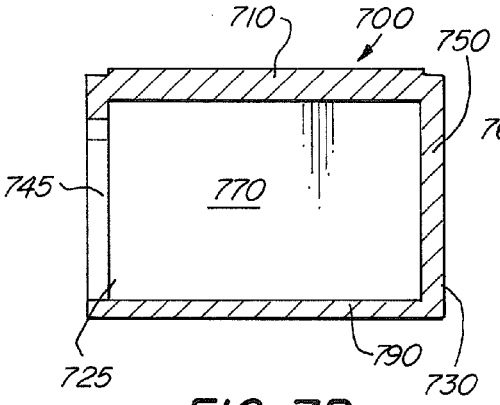
FIG. 7B is a cross section view of FIG. 7 taken along axis A-A.
Figure 7C:
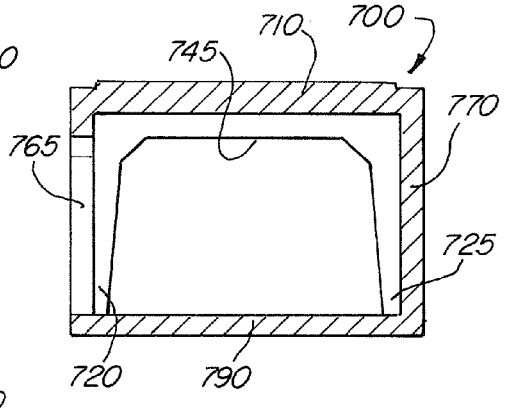
FIG. 7C is a cross section view of FIG. 7 taken along axis B-B.

FIGS. 7A, 7B and 7C show various views of module 700. FIG. 7A provides a top view where axes A-A and B-B are shown. FIG. 7B is a view across axis A-A where wall 770 is shown. Legs 725 and 730 are also shown in this view. FIG. 7C is a view across axis B-B where channel 745 is shown.

Figure 8A:
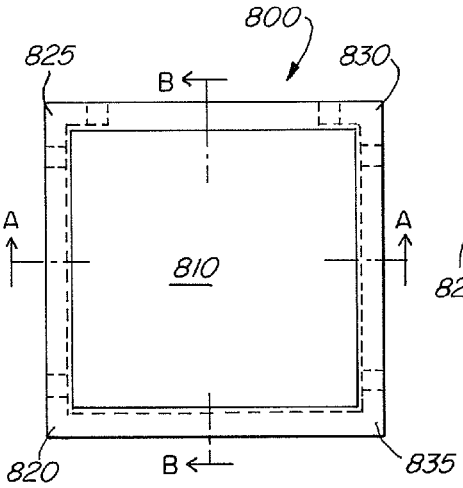
FIG. 8A is a top view of the module of FIG. 8.
Figure 8:
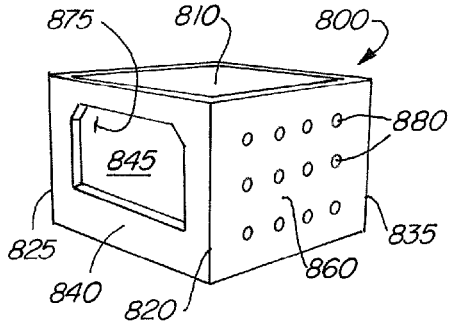
FIG. 8 is a perspective view of a module of the system of FIG. 1.

FIG. 8 shows another type of module in system 1000. Module 800 is shown having four legs 820, 825, 830 and 835. The four legs 820, 825, 830 and 835 each support horizontal deck 810. Each of the four legs 820, 825, 830 and 835 has a bottom edge.

Legs 820 and 825 are connected together via beam 840. Legs 820 and 835 are connected together via wall 860. Wall 860 is shown as a wall with perforations 880. Window 845 is also shown between the underside of horizontal deck 810 and the top of beam 840.

FIG. 8 also shows channel 875 formed in the space between bottom edges of the leg 825 and 830 to the underside of horizontal deck 810. Channel 875 allows for the water to flow through module 800. FIG. 8 also shows channel 855 formed in the space between bottom edges of the leg 830 and 835 to the underside of horizontal deck 810. Channel 855 allows for the water to flow through the module and is connected to channel 875.

Figure 8B:
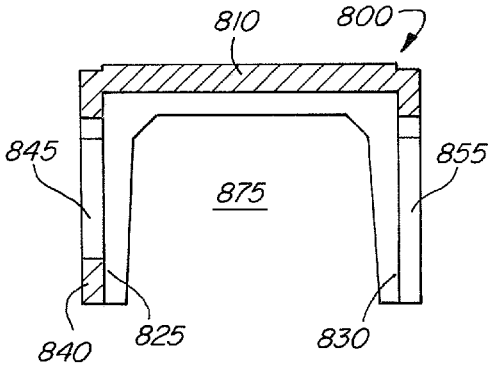
FIG. 8B is a cross section view of FIG. 8 taken along axis A-A.
Figure 8C:
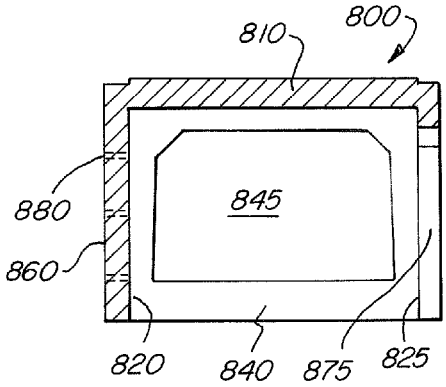
FIG. 8C is a cross section view of FIG. 8 taken along axis B-B.

FIGS. 8A, 8B and 8C show various views of module 800. FIG. 8A provides a top view where axes A-A and B-B are shown. FIG. 8B is a view across axis A-A where channel 875 is shown. Legs 825 and 830 are also shown in this view. FIG. 8C is a view across axis B-B where beam 840 and window 845 are shown.

Figure 11:
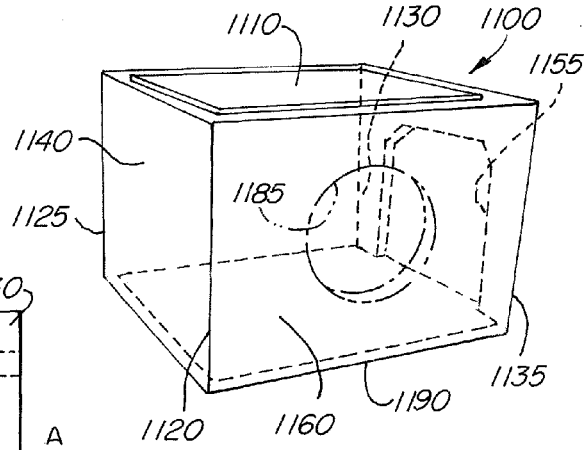
FIG. 11 is a perspective view of a module of the system of FIG. 1.

FIG. 11 shows another type of module in system 1000. Module 1100 is shown having four legs 1120, 1125, 1130 and 1135. Each of the four legs 1120, 1125, 1130 and 1135 support horizontal deck 1110. Each of the four legs 1120, 1125, 1130 and 1135 has a bottom edge. Furthermore, module 1100 has floor 1190.

Legs 1120 and 1125 are connected together via wall 1140. Legs 1125 and 1130 are connected together via wall 1170. Legs 1120 and 1135 are connected together via wall 1160. Walls 1140, 1160 and 1170 are shown as solid walls. Wall 1160 has an opening 1180, which allows for an inlet or outlet to be connected to module 1100. FIG. 11 also shows channel 1155 formed in the space between floor 1190 and the underside of horizontal deck 1110. Channel 1155 allows for the water to flow through the module. The water may flow through and enter/exit the module via opening 1185 or channel 1155.

Figure 11A:
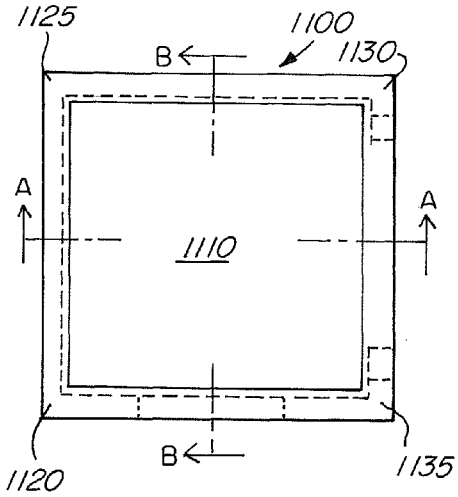
FIG. 11A is a top view of the module of FIG. 11.
Figure 11B:
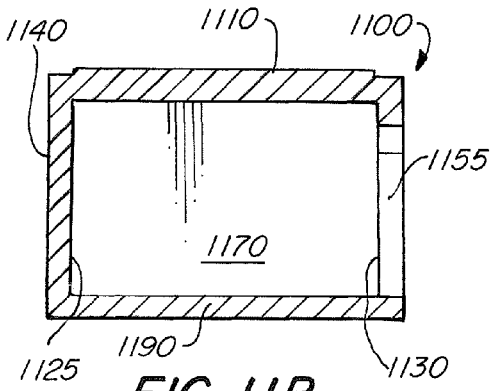
FIG. 11B is a cross section view of FIG. 11 along axis A-A.
Figure 11C:
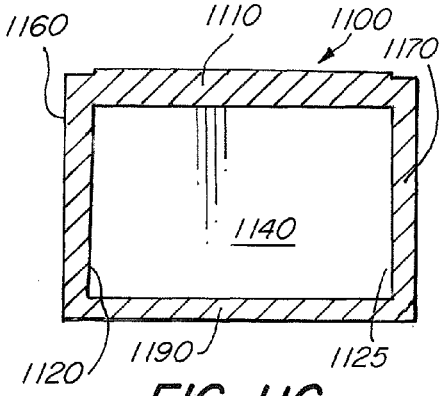
FIG. 11C is a cross section view of FIG. 11 along axis B-B.

FIGS. 11A, 11B and 11C show various views of module 1100. FIG. 11A provides a top view where axes A-A and B-B are shown. FIG. 11B is a view across axis A-A where wall 1170 is shown. Legs 1125 and 1130 are also shown in this view. FIG. 11C is a view across axis B-B where wall 1140 is shown.

Figure 12:
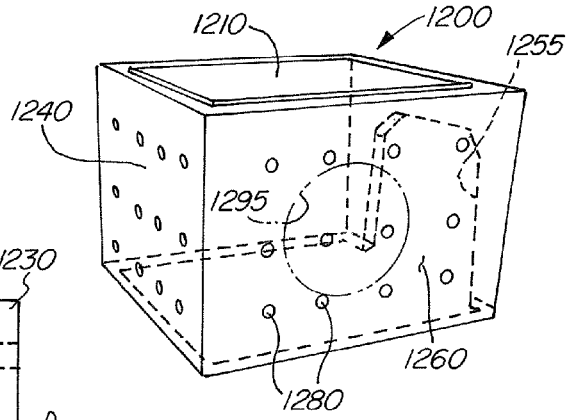
FIG. 12 is a perspective view of a module of the system of FIG. 1.

FIG. 12 shows a type of module in system 1000. Module 1200 is shown having four legs 1220, 1225, 1230 and 1235. The four legs 1220, 1225, 1230 and 1235 support horizontal deck 1210. Each of the four legs 1220, 1225, 1230 and 1235 has a bottom edge.

Legs 1220 and 1225 are connected together via wall 1240. Legs 1220 and 1235 are connected together via wall 1260. Walls 1240 and 1260 are shown having perforations 1280. Legs 1225 and 1230 are connected together via wall 1270. Wall 1270 is shown as being a solid wall. In certain embodiments solid wall 1270 may be replaced by a beam and a window. Wall 1260 also may have opening 1295 allowing for an inlet or outlet to be connected to module 1200. Such an opening 1295 is optional to module 1200.

FIG. 12 also shows channel 1255 formed in the space between bottom edges of the leg 1230 and 1235 to the underside of horizontal deck 1210. Channel 1255 allows for the water to flow through the module.

Figure 12A:
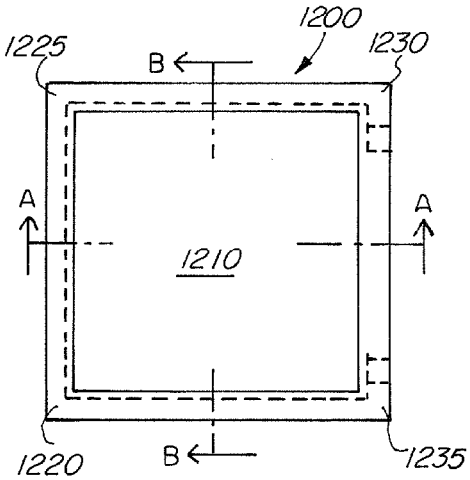
FIG. 12A is a top view of the module of FIG. 12.
Figure 12B:
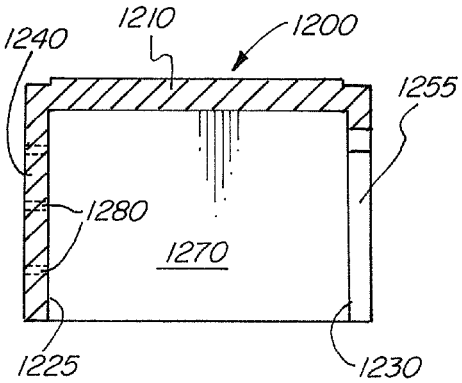
FIG. 12B is a cross section view of FIG. 12 along axis A-A.
Figure 12C:
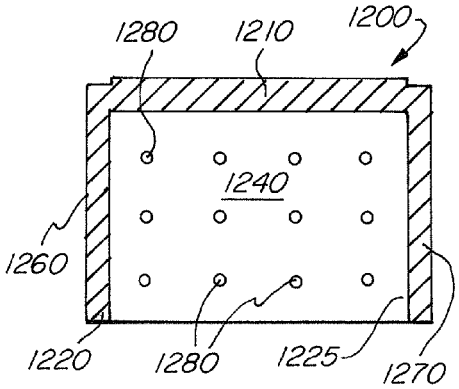
FIG. 12C is a cross section view of FIG. 12 along axis B-B.

FIGS. 12A, 12B and 12C show various views of module 1200. FIG. 12A provides a top view where axes A-A and B-B are shown. FIG. 12B is a view across axis A-A where wall 1270 is shown. Legs 1225 and 1230 are also shown in this view. FIG. 12C is a view across axis B-B where wall 1240 is shown.

Figure 9:
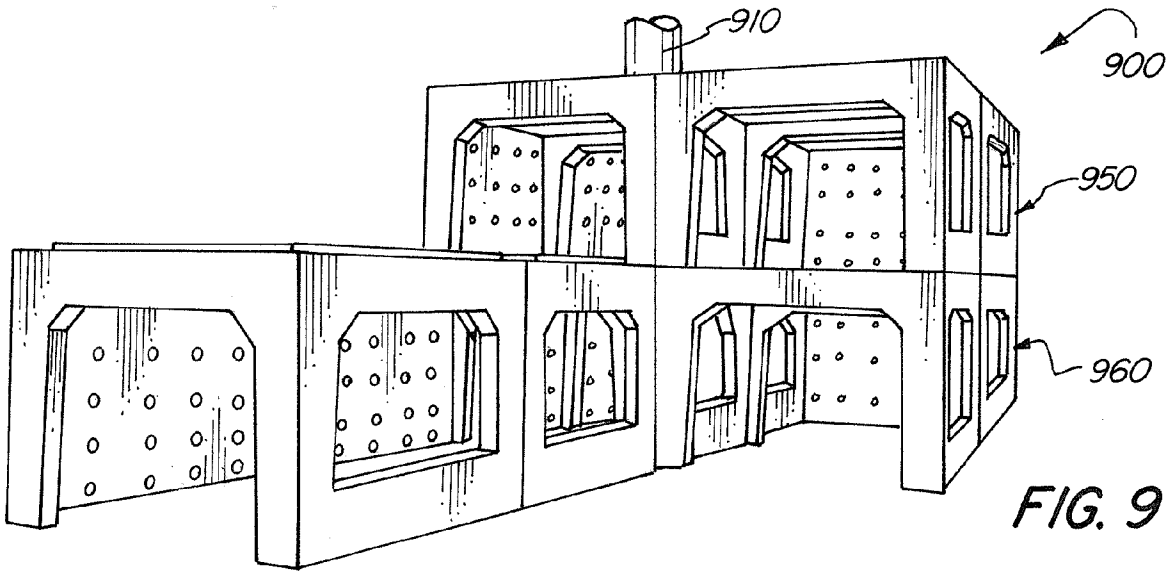
FIG. 9 is a perspective view of another embodiment of the system.
Figure 9A:
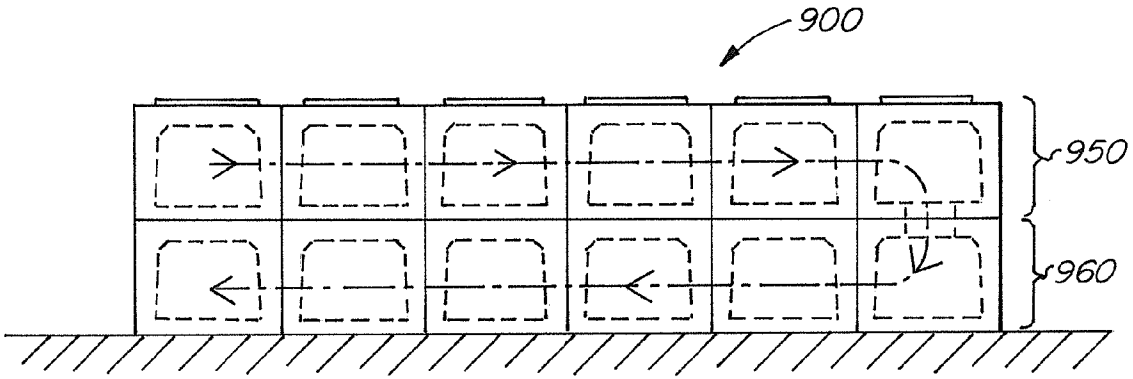
FIG. 9A is a side view of the system shown in FIG. 9.

FIGS. 9 and 9A each show another embodiment of the invention, system 900. System 900 is made of various modules, and may have some of the modules previously described. System 900 is shown having an inlet 910 and having two stacks of modules, upper stack 950 and lower stack 960. Various modules previously described (modules 200, 300, 400, 500, 600 and 800) may be used in system 900. Furthermore, additional modules may also be used in system 900.

Figure 10:
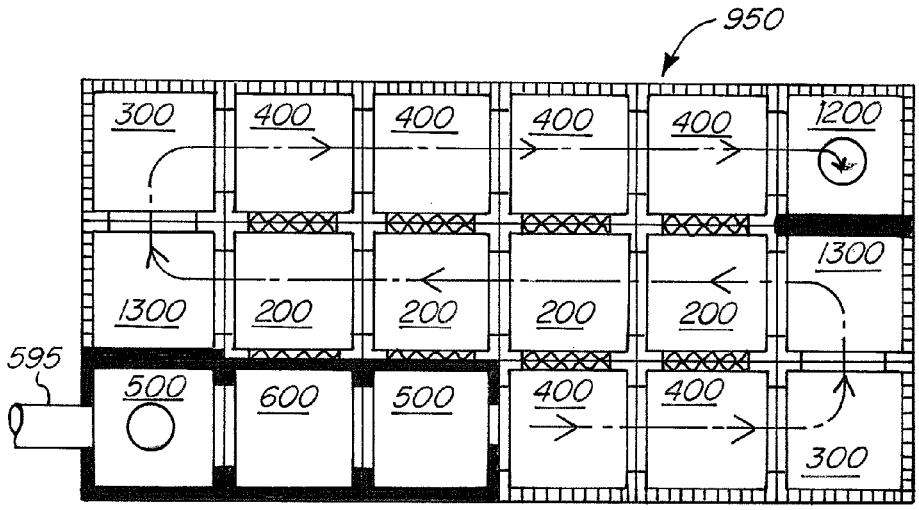
FIG. 10 is a grid view of the top portion of the system shown in FIG. 9.
Figure 10A:
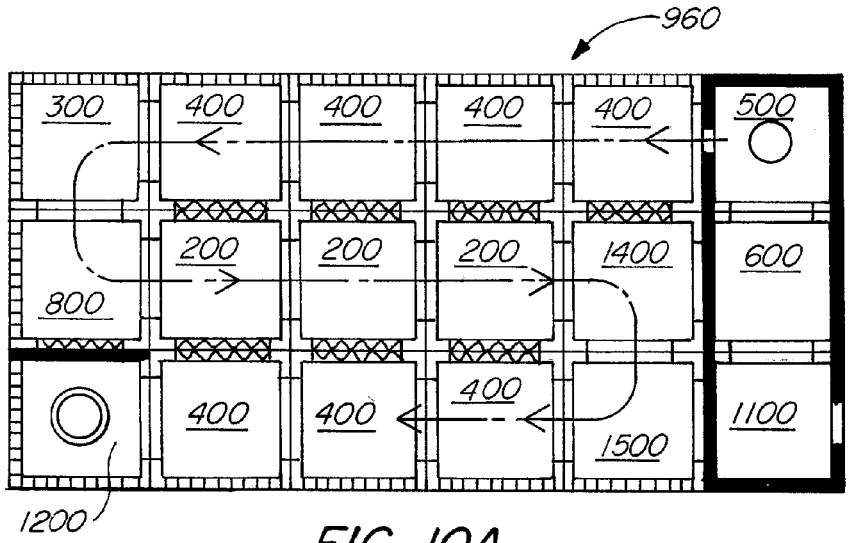
FIG. 10A is a grid view of the bottom portion of the system shown in FIG. 9.

FIGS. 10 and 10A show a schematic or grid view of system 900. FIG. 10 is a view of upper stack 950. FIG. 10A is a view of lower stack 960. Various modules previously described may be used for upper stack 950 and lower stack 960. Upper stack 950 and lower stack 960 work together as a coordinated multilayer system. Inlet/outlet 595 is shown in FIG. 10. Other inlets and/or outlets may be incorporated into system 900.

Figure 13A:
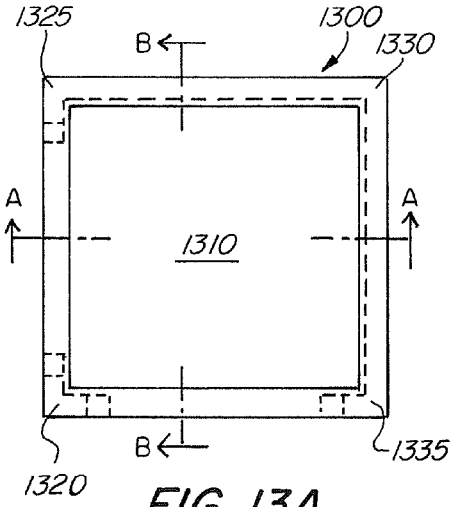
FIG. 13A is a top view of the module of FIG. 13.
Figure 13:
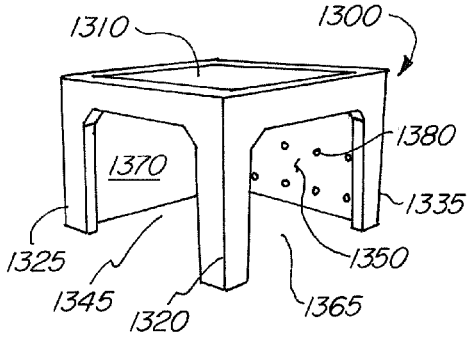
FIG. 13 is a perspective view of a module of the system of FIG. 1.

FIG. 13 shows a type of module in system 900. Module 1300 is shown having four legs 1320, 1325, 1330 and 1335. The four legs 1320, 1325, 1330 and 1335 support horizontal deck 1310. Each of the four legs 1320, 1325, 1330 and 1335 has a bottom edge.

Legs 1325 and 1330 are connected together via wall 1370. Wall 1370 is shown as a solid wall. Legs 1330 and 1335 are connected together via wall 1350. Wall 1350 is shown having perforations 1380.

FIG. 13 also shows channel 1345 formed in the space between bottom edges of the leg 1320 and 1325 to the underside of horizontal deck 1310. Channel 1345 allows for the water to flow through the module. FIG. 13 also shows channel 1365 formed in the space between bottom edges of the leg 1320 and 1335 to the underside of horizontal deck 1310. Channel 1365 allows for the water to flow through the module and is connected to channel 1345.

Figure 13B:
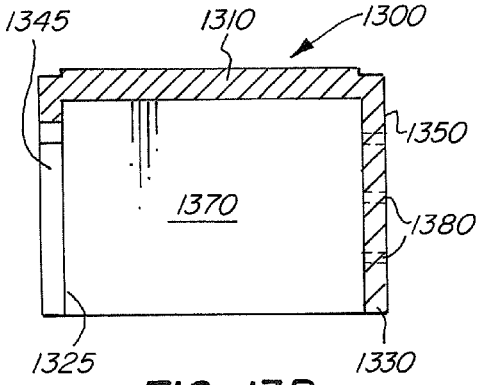
FIG. 13B is a cross section view of FIG. 13 along axis A-A.
Figure 13C:
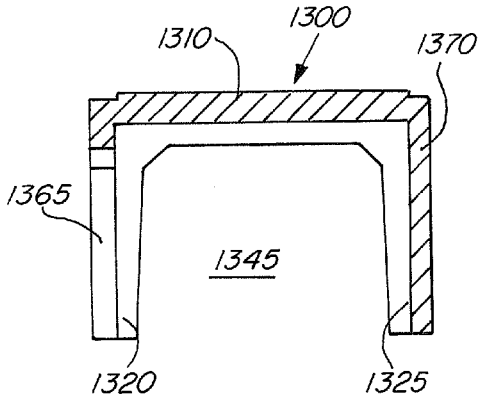
FIG. 13C is a cross section view of FIG. 13 along axis B-B.

FIGS. 13A, 13B and 13C show various views of module 1300. FIG. 13A provides a top view where axes A-A and B-B are shown. FIG. 13B is a view across axis A-A where wall 1370 is shown. Legs 1325 and 1330 are also shown in this view. FIG. 13C is a view across axis B-B where channel 1345 is shown.

Figure 14A:
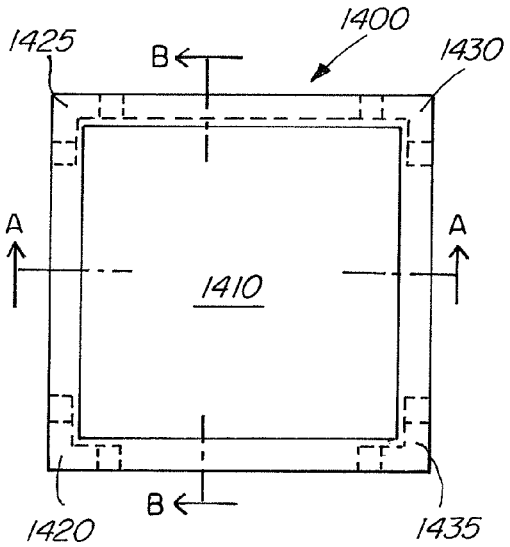
FIG. 14A is a top view of the module of FIG. 14.
Figure 14:
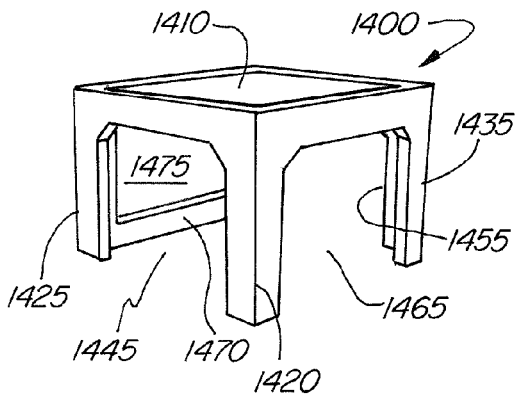
FIG. 14 is a perspective view of a module of the system of FIG. 9.

FIG. 14 shows another type of module in system 900. Module 1400 is shown having four legs 1420, 1425, 1430 and 1435. The four legs 1420, 1425, 1430 and 1435 support horizontal deck 1410. Each of the four legs 1420, 1425, 1430 and 1435 has a bottom edge.

Legs 1425 and 1430 are connected together via beam 1470. Window 1475 is shown between the underside of horizontal deck 1410 and the top of beam 1470.

FIG. 14 also shows channel 1445 formed in the space between the underside of horizontal deck 1410 and the floor and between leg 1420 and leg 1425. Channel 1445 allows for the water to flow through the module. FIG. 14 also shows channel 1455 formed in the space between the underside of horizontal deck 1410 and the floor and between leg 1430 and leg 1435. Channel 1455 allows for the water to flow through the module and is connected to channel 1445. FIG. 14 also shown channel 1465 formed in the space between the underside of horizontal deck 1410 and the floor and between leg 1420 and leg 1435. Channel 1465 allows for the water to flow through the module and is connected to channel 1445 and channel 1455.

Figure 14B:
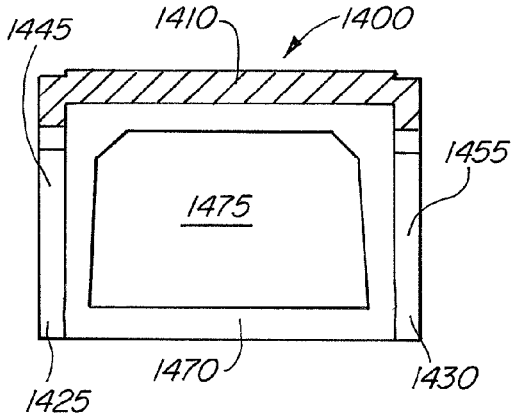
FIG. 14B is a cross section view of FIG. 14 along axis A-A.
Figure 14C:
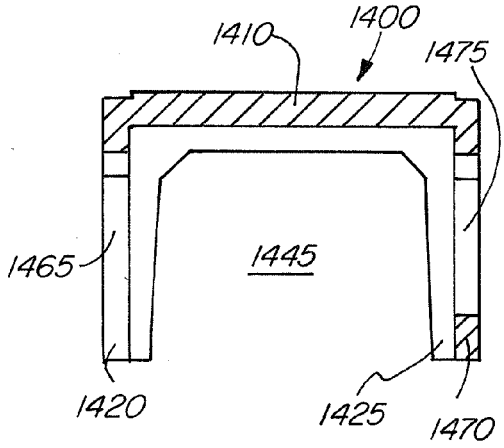
FIG. 14C is a cross section view of FIG. 14 along axis B-B.

FIGS. 14A, 14B and 14C show various views of module 1400. FIG. 14A provides a top view where axes A-A and B-B are shown. FIG. 14B is a view across axis A-A where beam 1470 and window 1475 are shown. Legs 1425 and 1430 are also shown in this view. FIG. 14C is a view across axis B-B where channel 1445/1465 is shown.

Figure 15A:
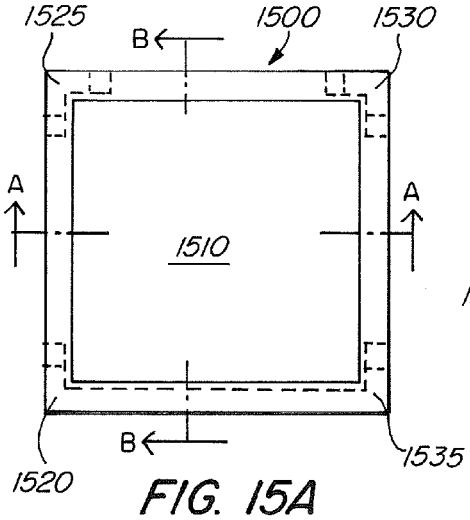
FIG. 15A is a top view of the module of FIG. 15.
Figure 15:
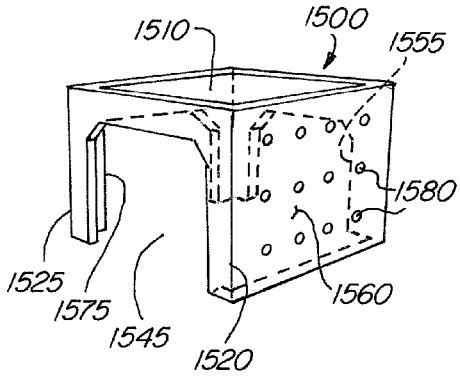
FIG. 15 is a perspective view of a module of the system of FIG. 9.

FIG. 15 shows another type of module in system 900. Module 1500 is shown having four legs 1520, 1525, 1530 and 1535. The four legs 1520, 1525, 1530 and 1535 support horizontal deck 1510. Each of the four legs 1520, 1525, 1530 and 1535 has a bottom edge.

Legs 1520 and 1535 are connected together via wall 1560. Wall 1560 is shown as having perforations 1580.

FIG. 15 also shows channel 1545 formed in the space between bottom edges of the leg 1520 and 1525 to the underside of horizontal deck 1510. Channel 1545 allows for the water to flow through the module. FIG. 15 also shows channel 1575 formed in the space between bottom edges of the leg 1525 and 1530 to the underside of horizontal deck 1510. Channel 1575 allows for the water to flow through the module and is connected to channel 1545. FIG. 15 also shows channel 1555 formed in the space between bottom edges of the leg 1530 and 1535 to the underside of horizontal deck 1510. Channel 1555 allows for the water to flow through the module and is connected to channel 1545 and 1575.

Figure 15B:
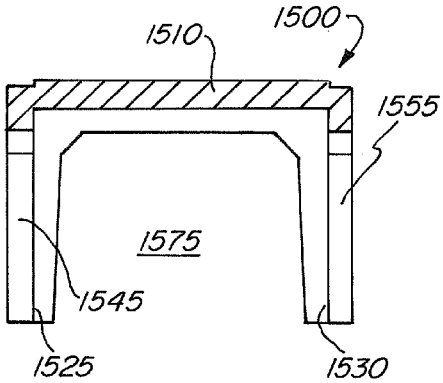
FIG. 15B is a cross section view of FIG. 15 along axis A-A.
Figure 15C:
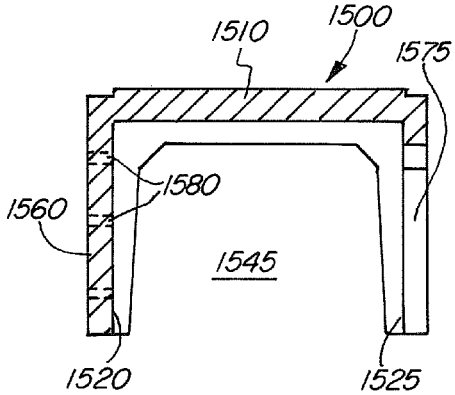
FIG. 15C is a cross section view of FIG. 15 along axis B-B.

FIGS. 15A, 15B and 15C show various views of module 1500. FIG. 15A provides a top view where axes A-A and B-B are shown. FIG. 15B is a view across axis A-A where channel 1575 is shown. Legs 1525 and 1530 are also shown in this view. FIG. 15C is a view across axis B-B where channel 1545/1555 is shown.

Figure 16:
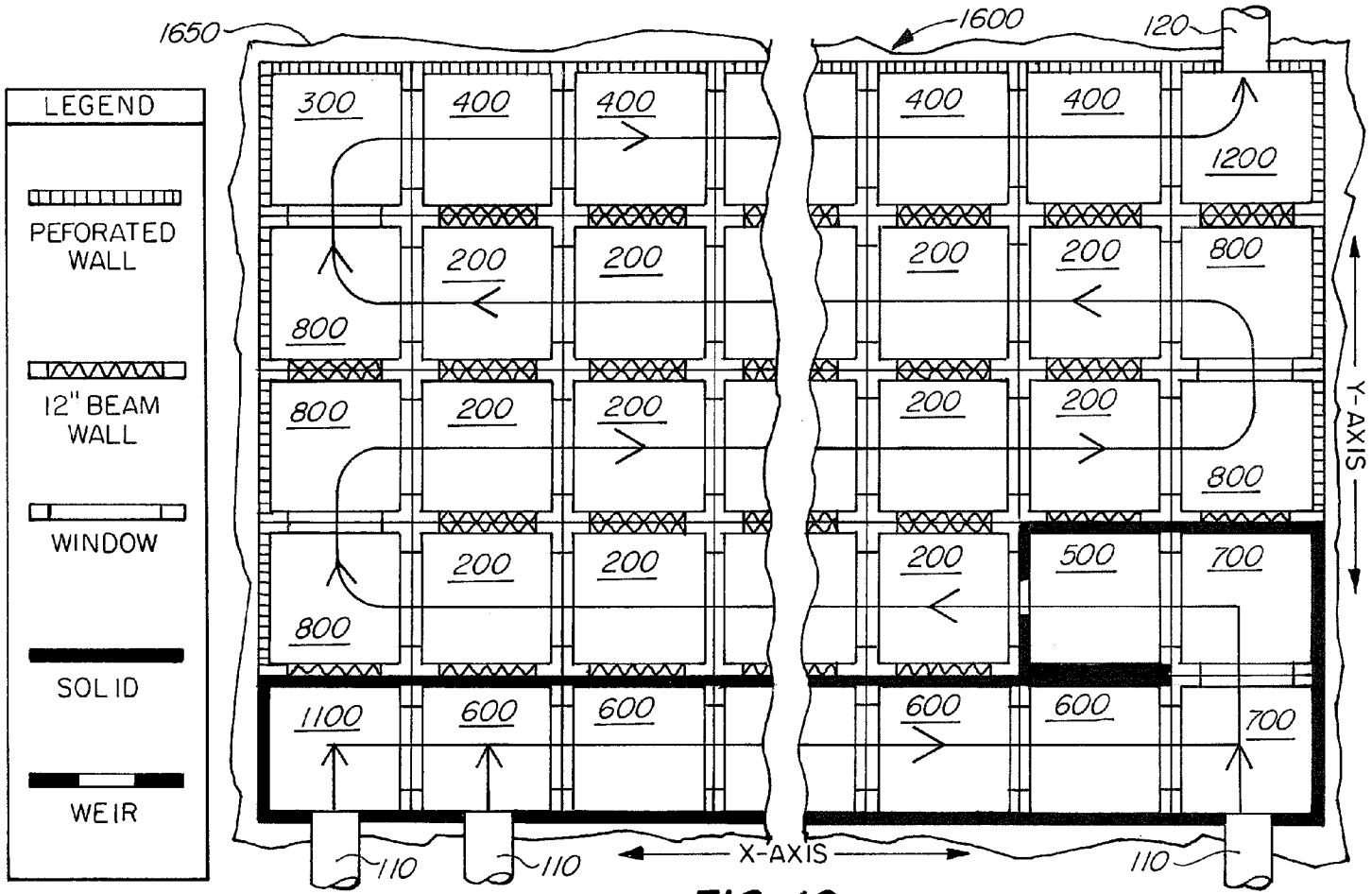
FIG. 16 is a grid view of another embodiment of the system.

FIG. 16 shows a storage and controlled outflow system 1600. System 1600 is made of various modules. System 1600 is shown having three inlets 110 and one outlet 120. However, there may be more inlets or less inlets 110 and outlets 120 for system 1600 than shown in FIG. 16. The modules previously described (modules 200, 300, 400, 500, 600, 700, 800, 1100 and 1200) are shown as being used for system 1600. Furthermore, system 1600 is shown having a liner 1650. This liner may be non-perforate and may not allow (i.e. prevent or stop) the water to exit the system through liner 1650. This acts to retain the water in the system. The liner may increase the amount of the water in the system, until it exits through various openings in the system.

The modules of various embodiments of the invention are preferably made of concrete, however they may be made of other material, such as cement, gravel, aggregate (such as crushed rock or gravel made of limestone or granite, plus a fine aggregate such as sand). Such materials should be able to support a load. The modules preferably have a reinforced steel frame within the modules for support, and an outer concrete shell. Such a steel frame allows the modules strength to support a load.

The modules may have a man hole located at the top of the modules. The man hole allows maintenance people to enter the module in the event trash enters the module, and/or the modules need to be cleaned. In certain embodiments, the openings the modules are large enough to allow a man to enter the modules.

The modules may have an outlet weir with trash rack installed across the weir opening. The modules may have baffles located within the modules. The modules may have other such advantages that allow for flow control in the module.

Such flow control may also allow the modules to have a sump feature. The modules may also have an optional orifice located on various walls of the modules. The optional orifice may be larger than the perforations shown in the modules, which typically have a diameter of only a few inches. The orifice is typically 24 inches in diameter, however, the orifice described may be larger or smaller than 24 inches depending upon the size of the module.

Other objectives of the modular system may be met by providing various other modules to assist in flow control of the water within a system. These modules may have water treatment advantages that allow for the water to be treated as it flows through the system.

These treatment modules may have perforated walls and beams. The treatment modules may have an outlet hole or backwall. The outlet hole on backwall may be 24 inches. The modules may have a 12 inch sump height. The treatment modules may have a filter media to treat the water. The modules may have a trash rack and weir system to control the flow of water. The modules may have filtering, oil/water separation, TSS (total suspended solids), removal, trash and debris removal, nutrient reduction, soluble chemical capture, all dependent on placement of weirs, walls, baffles, beams, and internal outlet control devices. The treatment modules may have filtering, temperature regulation, oxygenation, introduction of chemical treatment, and sterilization capabilities all related to compartmentalized and indirect flow systems).

The treatment modules may have filter media within the modules. The modules may have an underflow collection system within the modules. The treatment modules may have an outlet pipe that is connected to the filter media. The treatment modules may be located where the modules have a floor such as modules 500, 600 and 1100. The treatment modules may also be located where the floor of the system is made of stone.

The treatment modules may be arranged in a flow pattern that is serpentine. This allows the water to stay in the system for the optimal amount of time for treatment before exiting the system. This allows for optimal treatment of the water.

Figure 17:
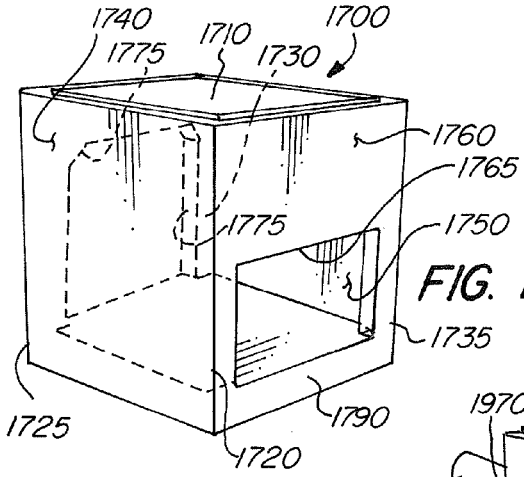
FIG. 17 is a perspective view of a module of the system of the invention.

FIG. 17 shows a type of treatment module in the modular system of the invention. Module 1700 is shown having four legs 1720, 1725, 1730 and 1735. The four legs 1720, 1725, 1730 and 1735 support horizontal deck 1710. Each of the four legs 1720, 1725, 1730 and 1735 has a bottom edge.

Legs 1720 and 1725 are connected together via a wall 1740. Legs 1720 and 1735 are connected together via wall 1760. Baffle 1765 is shown beneath wall 1760. The space between legs 1725 and 1730 forms channel 1775. Wall 1750 is shown as being a solid wall between legs 1730 and 1735. The module 1700 is also shown having a floor 1790.

Figure 18:
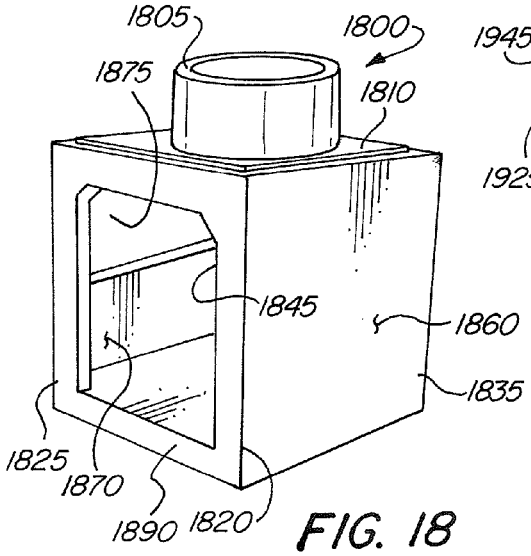
FIG. 18. is a perspective view of a module of the system of the invention.

FIG. 18 shows a type of treatment module in the modular system of the invention. Module 1800 is shown having four legs 1820, 1825, 1830 and 1835. The four legs 1820, 1825, 1830 and 1835 support horizontal deck 1810. Each of the four legs 1820, 1825, 1830 and 1835 has a bottom edge. Horizontal deck 1810 has riser 1805. Riser 1805 may be 24 inches in height. Riser 1805 may be more or less than 24 inches in height.

Legs 1820 and 1825 are connected together to form a channel 1845. Legs 1820 and 1835 are connected together via wall 1860. Legs 1825 and 1830 are connected together to form a low wall 1870. An opening 1875 is shown above low wall 1870. The module 1800 is also shown having a floor 1890.

Figure 19:
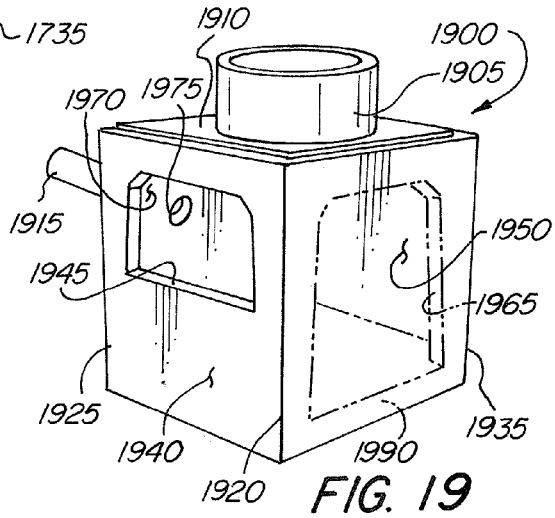
FIG. 19 is a perspective view of a module of the system of the invention.

FIG. 19 shows a type of treatment module in the modular system of the invention. Module 1900 is shown having four legs 1920, 1925, 1930 and 1935. The four legs 1920, 1925, 1930 and 1935 support horizontal deck 1910. Each of the four legs 1920, 1925, 1930 and 1935 has a bottom edge. Horizontal deck 1910 has riser 1905. Riser 1905 may be 24 inches in height. Riser 1905 may be more or less than 24 inches in height.

Legs 1920 and 1925 are connected together via low wall 1940. Window 1945 is shown above low wall 1940. Legs 1925 and 1930 are connected to form a wall 1970. Opening 1975 is shown in the wall connected to an outlet 1915. Legs 1930 and 1935 are connected together to form a wall 1950. Legs 1920 and 1935 are connected together via channel 1965. The module 1900 is also shown having a floor 1990.

Figure 20:
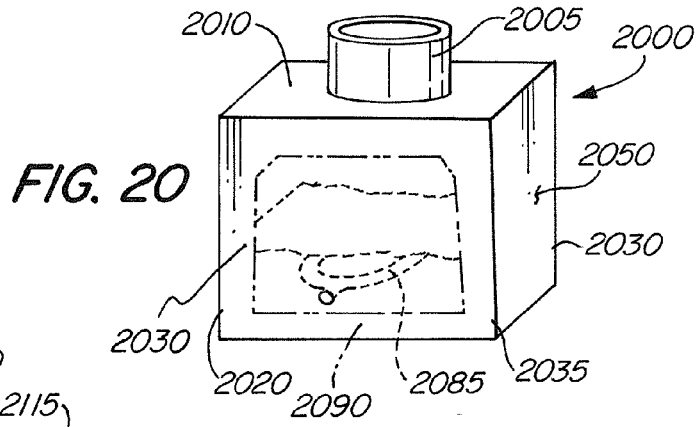
FIG. 20 is a perspective view of a module of the system of the invention.

FIG. 20 shows a type of treatment module in the modular system of the invention. Module 2000 is shown having four legs 2020, 2025, 2030 and 2035. The four legs 2020, 2025, 2030 and 2035 support horizontal deck 2010. Each of the four legs 2020, 2025, 2030 and 2035 has a bottom edge. Horizontal deck 2010 has riser 2005. Riser 2005 may be 24 inches in height. Riser 2005 may be more or less than 24 inches in height. Inside module 2000 is filter media 2030 and outlet pipe 2085. Legs 2030 and 2035 are connected by wall 2050.

Figure 21:
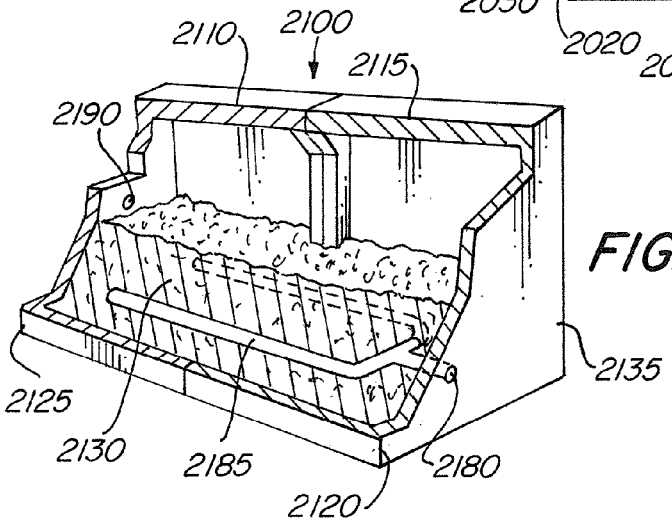
FIG. 21 is a perspective view of a module of the system of the invention.

FIG. 21 shows a type of treatment module in the modular system of the invention. Module 2100 is shown having four corners 2120, 2125, 2130 and 2135. Module 2100 is actually made up of two separate modules 2110 and 2115. Located inside module 2100 is filter media 2130 and output pipe 2180. Output pipe 2180 is connected to underflow collection system 2185. Filter media 2130 is used to filter and/or treat water.

Figure 22:
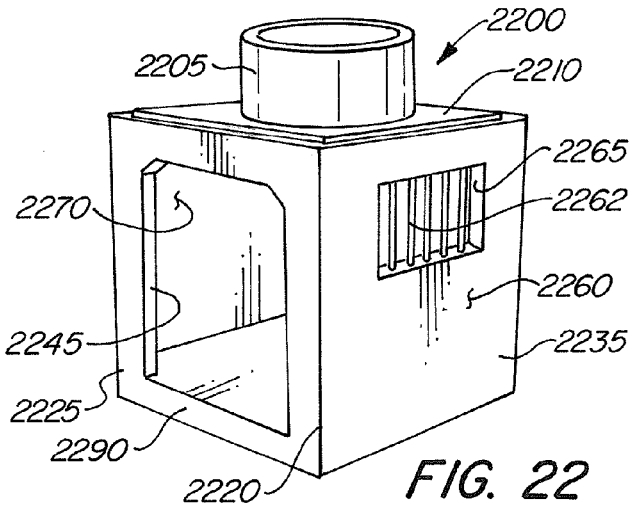
FIG. 22 is a perspective view of a module of the system of the invention.

FIG. 22 shows a type of treatment module in the modular system of the invention. Module 2200 is shown having four legs 2220, 2225, 2230 and 2235. The four legs 2220, 2225, 2230 and 2235 support horizontal deck 2210. Each of the four legs 2220, 2225, 2230 and 2235 has a bottom edge. Horizontal deck 2210 has riser 2205. Riser 2205 may be 24 inches in height.

Legs 2220 and 2225 are connected together to form a channel 2245. Legs 2220 and 2235 are connected together via wall 2260. Weir 2265 is above wall 2260. Trash rack 2262 is shown installed in weir 2265. Legs 2225 and 2230 are connected together via wall 2270. Module 2200 is also shown having a floor 2290.

Various embodiments of the system may be arranged as either sealed or non-sealed systems. Sealed systems may have a non-perforate liner or another such barrier that will prevent the water from leaving the system. Sealed systems typically only allow water to leave the system via inlets and outlets.

Non-sealed systems do not have a non-perforate liner. Water may leave the non-sealed systems via perforations in the walls of the perimeter modules and the outlets of the system. Furthermore, in a non-sealed system, water may leave through the floor of the system.

Other embodiments of the invention involve having stackable systems with a drop outlet structure with control orifice. The drop outlet structure is for a multilayer or stackable system (as shown in FIGS. 9, 9A, 10 and 10A), where the water drops from a module in the upper stack to a module in the lower stack. In such a system, the modules may be arranged stacked on a stone base. Such a system may have an outlet control rise with orifice holes and an overflow weir. Such a system may have various weirs located in the system to control flow in the system for accumulation of water.

FIGS. 2B, 2C, 3B, 3C, 4B, 4C, 5B, 5C, 6B, 6C, 7B, 7C, 8B, 8C, 11B, 11C, 12B, 12C, 13B, 13C, 14B and 14C allow show modules that may be stackable or are adapted to be stackable. These modules have indentations shown in the top right and top left of each module that are adapted to receive the legs of a corresponding module. This allows the modules to be stacked upon one another. Modules, thus, have a lateral friction element that prevents the modules from moving.

In certain embodiments, stackable systems may also involve a top level not have a floor (floorless) and the bottom level not have a ceiling (ceilingless), creating a height volume area of twice the size of a module. Certain embodiments also are directed to mixed systems with a mixture of double-stack and single-stack systems. Such systems have a mixture of volume heights, as modules of smaller and greater sizes may be used in such systems.

Figure 23:
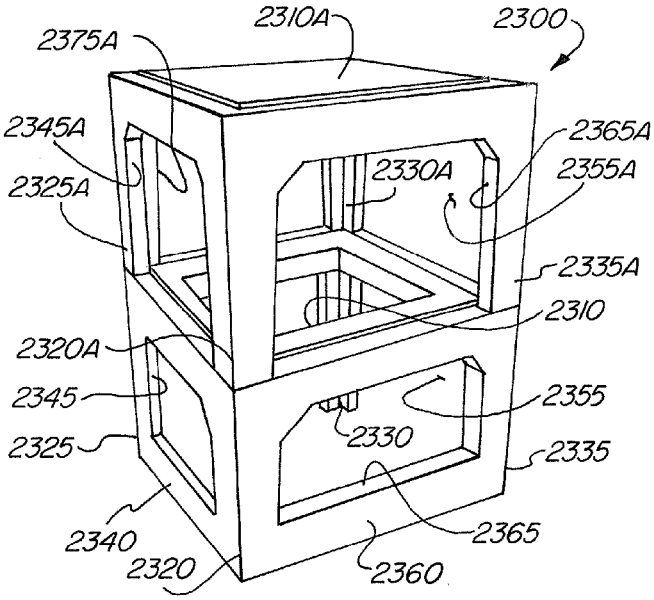
FIG. 23 is a perspective view of a module of the system of the invention.

FIGS. 23-28 show examples of stackable modules. FIG. 23 shows a type of stackable module that may be used is a multilayer or stacked system. Module 2300 is shown as being made of two modules, a lower module and an upper module. The lower module has four legs 2320, 2325, 2330 and 2335. The four legs 2320, 2325, 2330 and 2335 support the upper module. Each of the four legs 2320, 2325, 2330 and 2335 has a bottom edge. The upper module also has four legs 2320A, 2325A, 2330A, and 2335A. Each of the four legs 2320A, 2325, 2330A and 2335A has a bottom edge. The four legs 2320A, 2325A, 2330A and 2335A support a horizontal deck 2310A. Legs 2320 and 2325 are connected together by a beam 2340. Window 2345 is shown above beam 2340. Legs 2320 and 2335 are connected via beam 2360 with window 2365 shown above beam 2360.

Channel 2355 is shown between leg 2330 and 2335; channel 2345A is shown between leg 2320A and 2325A; channel 2375A is shown between leg 2325A and 2330A; channel 2355A is shown between let 2330A and 2335A; and channel 2365A is shown between leg 2320A and 2335A. The lower module has opening 2310 in its ceiling instead of having a horizontal deck.

Figure 24:
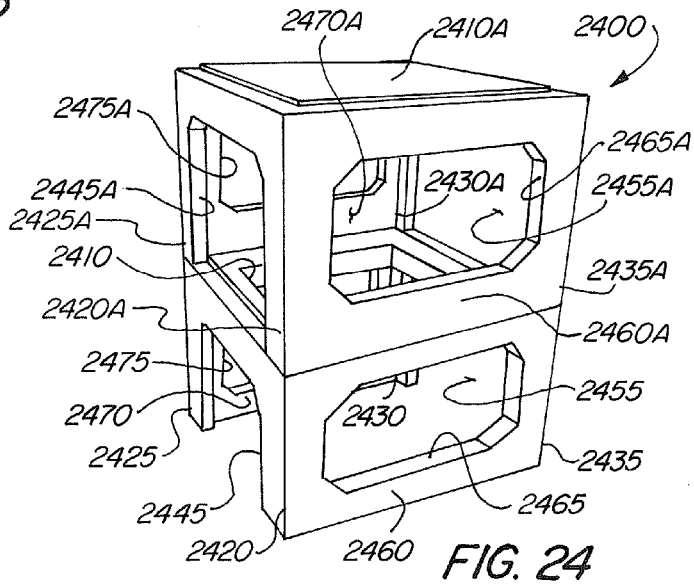
FIG. 24 is a perspective view of a module of the system of the invention.

FIG. 24 shows a type of stackable module that may be used is a multilayer or stacked system. Module 2400 is shown as being made of two modules, a lower module and an upper module. The lower module has four legs 2420, 2425, 2430 and 2345. The four legs 2420, 2425, 2430 and 2435 support the upper module. Each of the four legs 2420, 2425, 2430 and 2435 has a bottom edge. The upper module also has four legs 2420A, 2425A, 2430A, and 2435A. Each of the four legs 2420A, 2425, 2430A and 2435A has a bottom edge. The four legs 2420A, 2425A, 2430A and 2435A support a horizontal deck 2410A.

Legs 2420 and 2435 are connected together by a beam 2460. Window 2465 is shown above beam 2460. Legs 2420A and 2435A are connected via beam 2460A with window 2465A shown above beam 2460A. Legs 2425 and 2430 are connected together via beam 2470. Window 2475 is shown above beam 2470. Legs 2425A and 2430A are connected together via beam 2470A. Window 2475A is shown above beam 2470A. Channel 2455 is shown between leg 2430 and 2435; channel 2455A is shown between leg 2430A and 2435A; channel 2445 is shown between leg 2420 and 2425; and channel 2445A is shown between leg 2320A and 2325A. The lower module has opening 2410 in its ceiling instead of having a horizontal deck.

Figure 25:
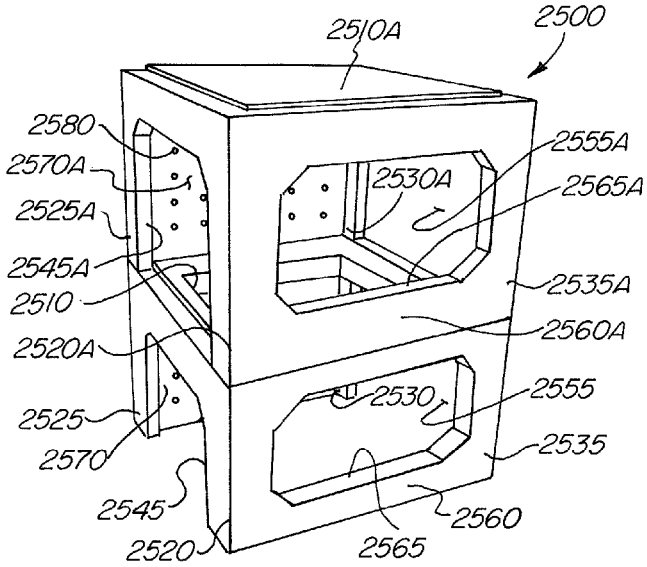
FIG. 25 is a perspective view of a module of the system of the invention.

FIG. 25 shows a type of stackable module that may be used is a multilayer or stacked system. Module 2500 is shown as being made of two modules, a lower module and an upper module. The lower module has four legs 2520, 2525, 2530 and 2545. The four legs 2520, 2525, 2530 and 2535 support the upper module. Each of the four legs 2520, 2525, 2530 and 2535 has a bottom edge. The upper module also has four legs 2520A, 2525A, 2530A, and 2535A. Each of the four legs 2520A, 2525, 2530A and 2535A has a bottom edge. The four legs 2520A, 2525A, 2530A and 2535A support a horizontal deck 2510A.

Legs 2520 and 2535 are connected together by a beam 2560. Window 2565 is shown above beam 2560. Legs 2520A and 2535A are connected via beam 2560A with window 2565A shown above beam 2560A. Legs 2525 and 2530 are connected together via wall 2570. Legs 2525A and 2530A are connected together via wall 2570A. Perforations 2580 are shown in wall 2570 and wall 2570A. Channel 2555 is shown between leg 2530 and 2455; channel 2555A is shown between leg 2530A and 2535A; channel 2545 is shown between leg 2520 and 2525; and channel 2545A is shown between leg 2520A and 2525A. The lower module has opening 2510 in its ceiling instead of having a horizontal deck.

Figure 26:
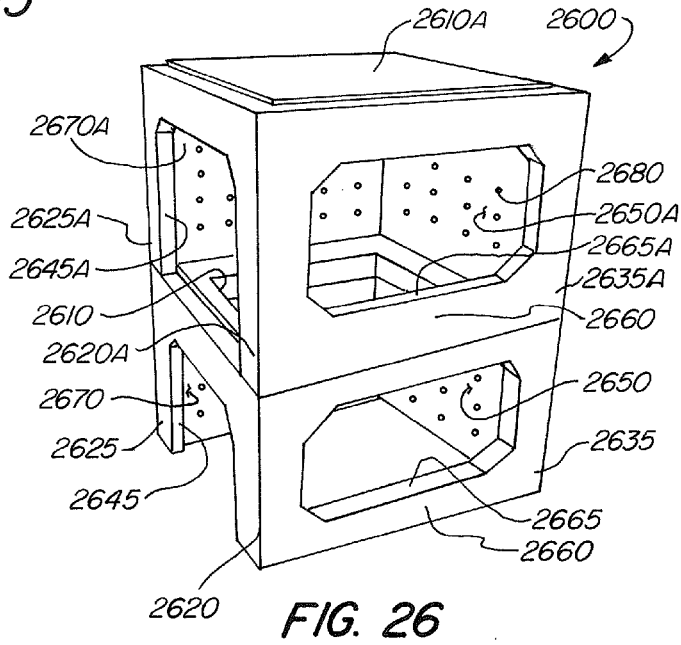
FIG. 26 is a perspective view of a module of the system of the invention.

FIG. 26 shows a type of stackable module that may be used is a multilayer or stacked system. Module 2600 is shown as being made of two modules, a lower module and an upper module. The lower module has four legs 2620, 2625, 2630 and 2645. The four legs 2620, 2625, 2630 and 2635 support the upper module. Each of the four legs 2620, 2625, 2630 and 2635 has a bottom edge. The upper module also has four legs 2620A, 2625A, 2630A, and 2635A. Each of the four legs 2620A, 2625, 2630A and 2635A has a bottom edge. The four legs 2620A, 2625A, 2630A and 2635A support a horizontal deck 2610A.

Legs 2620 and 2635 are connected together by a beam 2660. Window 2665 is shown above beam 2660. Legs 2620A and 2635A are connected together by a beam 2660A. Window 2665A is shown above beam 2660A. Legs 2625 and 2630 are connected together via wall 2670. Legs 2625A and 2630A are connected together via wall 2670A. Legs 2630 and 2635 are connected together via wall 2650. Legs 2630A and 2635A are connected together via wall 2650A. Perforations 2680 are shown in wall 2670, wall 2670A, wall 2650 and wall 2650A. Channel 2645 is shown between leg 2620 and 2625; and channel 2645A is shown between leg 2620A and 2625A. The lower module has opening 2610 in its ceiling instead of having a horizontal deck.

Figure 27:
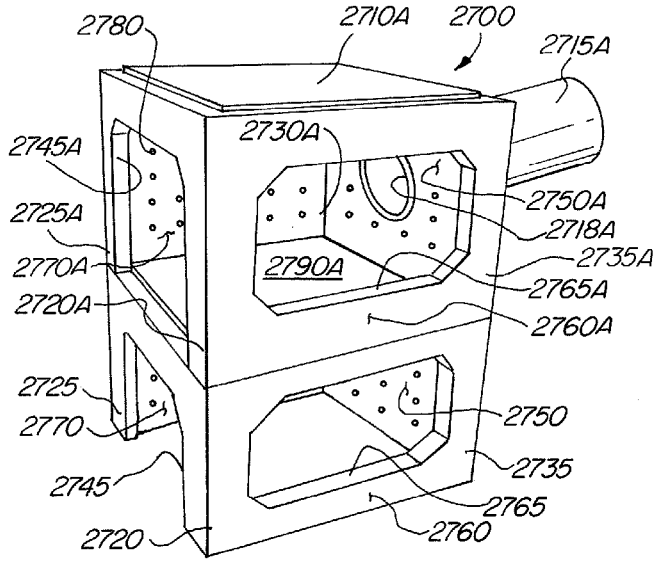
FIG. 27 is a perspective view of a module of the system of the invention.

FIG. 27 shows a type of stackable module that may be used is a multilayer or stacked system. Module 2700 is shown as being made of two modules, a lower module and an upper module. The lower module has four legs 2720, 2725, 2730 and 2745. The four legs 2720, 2725, 2730 and 2735 support the upper module. Each of the four legs 2720, 2725, 2730 and 2735 has a bottom edge. The upper module also has four legs 2720A, 2725A, 2730A, and 2735A. Each of the four legs 2720A, 2725, 2730A and 2735A has a bottom edge. The four legs 2720A, 2725A, 2730A and 2735A support a horizontal deck 2710A.

Legs 2720 and 2735 are connected together by a beam 2760. Window 2765 is shown above beam 2760. Legs 2720A and 2735A are connected together by a beam 2760A. Window 2765A is shown above beam 2760A. Legs 2725 and 2730 are connected together via wall 2770. Legs 2725A and 2730A are connected together via wall 2770A. Legs 2730 and 2735 are connected together via wall 2750. Legs 2730A and 2735A are connected together via wall 2750A. Perforations 2780 are shown in wall 2770, wall 2770A, wall 2750 and wall 2750A. Wall 2750A also has opening 2718 and output pipe 2715A. Channel 2745 is shown between leg 2720 and 2725; and channel 2745A is shown between leg 2720A and 2625A. The lower module has floor 2710A.

Figure 28:
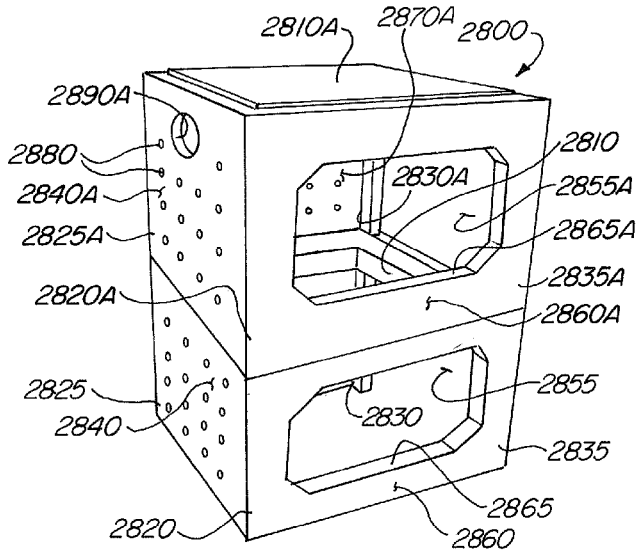
FIG. 28 is a perspective view of a module of the system of the invention.

FIG. 28 shows a type of stackable module that may be used is a multilayer or stacked system. Module 2800 is shown as being made of two modules, a lower module and an upper module. The lower module has four legs 2820, 2825, 2830 and 2845. The four legs 2820, 2825, 2830 and 2835 support the upper module. Each of the four legs 2820, 2825, 2830 and 2835 has a bottom edge. The upper module also has four legs 2820A, 2825A, 2830A, and 2835A. Each of the four legs 2820A, 2825, 2830A and 2835A has a bottom edge. The four legs 2820A, 2825A, 2830A and 2835A support a horizontal deck 2810A.

Legs 2820 and 2835 are connected together by a beam 2860. Window 2865 is shown above beam 2860. Legs 2820A and 2835A are connected together by a beam 2860A. Window 2865A is shown above beam 2860A. Legs 2825 and 2830 are connected together via wall 2870. Legs 2825A and 2830A are connected together via wall 2870A. Legs 2820 and 2825 are connected together via wall 2640. Legs 2820A and 2825A are connected together via wall 2840A. Perforations 2680 are shown in wall 2870, wall 2870A, wall 2840 and wall 2840A. Channel 2855 is shown between leg 2830 and 2835; and channel 2855A is shown between leg 2830A and 2835A. The lower module has opening 2810 in its ceiling instead of having a horizontal deck. Wall 2840A has an opening 2890A.

Dimensions of the modules shown in FIGS. 23-28 may be shown has having 12 inch beams (12 inches being the beam height); however, beams with other heights may be used, such as having beams that have a height of greater than 12 inches. The modules shown in FIGS. 23-28 are typically are approximately 8 feet wide and 8 feet deep and have a lower module height of 3 feet 8 inches and an upper modules height of 4 feet 8 inches when employing 12 inch beams. However, the modules shown in these figures can have a greater and smaller size. The modules can range in height, so as to allow a man to enter the module to service it.

Furthermore, modules typically have the ability to support 10,000 to 14,000 pounds of weight. However, modules may support additional weight based on materials used, such as having a steel frame internal to the concrete outer shell. Modules may be made of other materials known in the art, and may be made of materials that are more expensive and have greater load bearing capabilities, if desired.

Embodiments of the present invention have various advantages for the environment and have additional "green advantages" that have a positive impact on the environment. Notably, the present invention has a smaller environmental footprint, has more optimal use of area via geometry, and has less stone hauling and less material use than existing systems.

Embodiments of the present invention may do multiple processes, such as treatment, in a single module, and use less material and impact less surface area than existing systems. Embodiments of the present invention have stackability of the modules and/or may be a multilayered system, which reduces the environmental footprint of the systems.

Embodiments of the present invention have flow control to reduce erosion in receiving water, have water quality control treatment processes, have water reuse processing and storage, and also have irrigation runoff usage. Embodiments of the present invention have wastewater secondary grey water systems for use for irrigation, have non-sanitary water use and savings, treatment and storage.

Embodiments of the present invention may have water reuse for fire protection, temperature control of warmed parking lot runoff, wastewater detention relieving undersized public utilities loading, combine sewer storage and treatment, and surge flow protection. Embodiments of the present invention have ground water recharge, and may be used in conjunction with bio retention systems.

Embodiments of the present invention may support elements of green designs by virtue of the application. The material on construction is green by being a natural product. Embodiments of the present invention support fuel and energy reduction by a multi-use concept. Embodiments of the present invention support water reuse for secondary functions and water flow control to reduce the environmental impacts for receiving water, such as counterbalancing increased flows due to increase in hard surfaces.

While the invention has been specifically described in connection with certain specific embodiments thereof, it is to be understood that this is by way of illustration and not of limitation and that various changes and modifications in form and details may be made thereto, and the scope of the appended claims should be construed as broadly as the prior art will permit.

The description of the invention is merely exemplary in nature, and thus, variations that do not depart from the gist of the invention are intended to be within the scope of the invention. Such variations are not to be regarded as a departure from the spirit and scope of the invention.

What is claimed is:

1. A modular system for controlling a flow of water comprising:

a plurality of modules, at least some of the plurality of modules comprising a horizontal deck supported by four vertical members, each of the four vertical members having a bottom edge, the plurality of modules being arranged in a grid having an x-axis and a y-axis, the plurality of modules forming:

one or more longitudinal channels, the one or more longitudinal channels being defined in the direction along the y-axis of the modular system, and one or more lateral channels, the one or more lateral channels being defined in the direction along the x-axis of the modular system, wherein at least some of the plurality of modules have at least one beam extending across from one of the vertical members to another one of the vertical members of one of the modules, wherein the at least one beam extends partially upwards from the bottom edge of the one of the four vertical members towards the horizontal deck thereby creating a window, wherein the at least one beam is non-perforate to the flow of water, wherein the at least one beam has a vertical height and wherein the at least one beam directs the flow of the water when the water is below the top of the vertical height of the beam, and wherein the modular system controls the flow of the water in an indirect path.

2. The modular system of claim 1, wherein the system provides for uninterrupted flow along the one or more of the longitudinal channels, when the level of the water is below the top of the vertical height of the at least one beam.

3. The modular system of claim 1, wherein the system provides for uninterrupted flow along the one or more of the lateral channels, when the level of the water is below the top of the vertical height of the at least one beam.

4. The modular system of claim 1, further comprising a porous surface, the plurality of modules being located on the porous surface.

5. The modular system of claim 1, further comprising a nonporous surface, the plurality of modules being located on the nonporous surface.

6. A modular system for controlling a flow of water comprising:

a plurality of modules, at least some of the plurality of modules comprising a horizontal deck supported by four vertical members, the plurality of modules being arranged in a grid having an x-axis and a y-axis, the plurality of modules forming:

one or more longitudinal channels, the one or more longitudinal channels being defined in the direction along the y-axis of the modular system, and one or more lateral channels, the one or more lateral channels being defined in the direction along the x-axis of the modular system, wherein the modular system provides for serpentine flow through the longitudinal and lateral channels, wherein the serpentine flow is created by a plurality of horizontal beams that direct the flow of the water when the level of the water is below the top of the vertical height of each of the plurality of horizontal beams, wherein the plurality of horizontal beams are non-perforate to the flow of water.

7. A method for controlling a flow of water in a modular system comprising:

providing a plurality of modules, each of the plurality of modules comprising:

a horizontal deck supported by four vertical members, the plurality of modules being arranged in a grid having an x-axis and a y-axis, the plurality of modules forming one or more longitudinal channels, the one or more longitudinal channels being defined in the direction along the y-axis of the modular system, one or more lateral channels, the one or more lateral channels being defined in the direction along the x-axis of the modular system, wherein the at least some of the plurality of modules have at least one beam extending from one of the four vertical members to another one of the four vertical members, wherein the at least one beam extends partially upwards from the bottom edge of the one of the four vertical members towards the horizontal deck thereby creating a window, wherein the at least one beam is non-perforate to the flow of water; and inserting the water into the plurality of modules by natural or artificial means, wherein the water is directed through the system by the at least one beam in the plurality of modules, wherein the at least one beam directs the flow of the water when the water is below the vertical height of the beam.

8. The method of claim 7, wherein the water is routed through the modular system in a serpentine manner.

* * * * *